US008909107B2

(12) United States Patent
Sasaki et al.

(10) Patent No.: US 8,909,107 B2
(45) Date of Patent: Dec. 9, 2014

(54) TONER DISPERSING MECHANISM, DEVELOPING DEVICE INCLUDING THE TONER DISPERSING MECHANISM, AND IMAGE FORMING APPARATUS

(75) Inventors: Asami Sasaki, Osaka (JP); Hisashi Mukataka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 155 days.

(21) Appl. No.: 13/346,980

(22) Filed: Jan. 10, 2012

(65) Prior Publication Data

US 2012/0183334 A1 Jul. 19, 2012

(30) Foreign Application Priority Data

Jan. 19, 2011 (JP) ..... 2011-008393
Jan. 19, 2011 (JP) ..... 2011-008396

(51) Int. Cl.
*G03G 15/08* (2006.01)

(52) U.S. Cl.
CPC ..... *G03G 15/0839* (2013.01); *G03G 2215/085* (2013.01); *G03G 2215/0827* (2013.01)
USPC ..... 399/258; 399/254

(58) Field of Classification Search
CPC ..... G03G 15/08
USPC ..... 396/258; 399/258, 254
See application file for complete search history.

(56) References Cited

U.S. PATENT DOCUMENTS 5,629,758 A * 5/1997 Kageyama et al. ..... 399/263
5,708,939 A * 1/1998 Oikawa et al. ..... 399/252
7,593,672 B2 * 9/2009 Woo ..... 399/258
7,801,466 B2 * 9/2010 Hirose ..... 399/256
7,835,674 B2 * 11/2010 Woo ..... 399/258
7,904,002 B2 * 3/2011 Akedo ..... 399/254
2002/0067932 A1 6/2002 Arai et al.
2004/0179865 A1 * 9/2004 Nishiyama ..... 399/254
2007/0269235 A1 * 11/2007 Hirose ..... 399/254
2011/0229209 A1 * 9/2011 Takaya et al. ..... 399/257
2011/0229211 A1 * 9/2011 Ohashi et al. ..... 399/258
2012/0251185 A1 * 10/2012 Matsumoto ..... 399/258

FOREIGN PATENT DOCUMENTS

JP 59-95361 U 6/1984
JP 2-111161 9/1990
JP 4-66985 A 3/1992
JP 1992-066985 * 3/1992 ..... G03G 15/08
JP 4-139470 A 5/1992

(Continued)

*Primary Examiner* — Clayton E Laballe
*Assistant Examiner* — Kevin Butler
(74) *Attorney, Agent, or Firm* — Smith, Gambrell and Russell, LLP

(57) ABSTRACT

Provided is a toner dispersing mechanism arranged between a toner storage container and a developing device, for dispersing toner replenished from the toner storage container. The toner dispersing mechanism includes a housing, a toner dispersing member, and a projecting portion formed continuously at least at a part of an inner wall surface in a longitudinal direction of the housing. The housing includes a toner filling port communicating to the toner storage container, and a toner discharge port communicating to the developing device. The toner dispersing member includes a rotary shaft rotatably supported in the housing, and a large number of dispersing protrusions made of an elastic material and formed on an outer peripheral surface of the rotary shaft. The large number of dispersing protrusions face the part and come into contact with the projecting portion.

21 Claims, 15 Drawing Sheets

(56) References Cited

FOREIGN PATENT DOCUMENTS

| | | | | | |
|---|---|---|---|---|---|
| JP | 2000-275939 | | | 10/2000 | |
| JP | 2002-224622 | A | | 8/2002 | |
| JP | 2006-154151 | | * | 6/2006 | ..... G03G 15/08 |
| JP | 2006-154151 | A | | 6/2006 | |
| JP | 2007-72347 | A | | 3/2007 | |
| JP | 2007-147893 | | * | 6/2007 | ..... G03G 15/08 |
| JP | 2007-147893 | A | | 6/2007 | |
| JP | 2008-268783 | | | 11/2008 | |
| JP | 2008-304650 | | | 12/2008 | |

* cited by examiner

TONER DISPERSING MECHANISM, DEVELOPING DEVICE INCLUDING THE TONER DISPERSING MECHANISM, AND IMAGE FORMING APPARATUS

INCORPORATION BY REFERENCE

This application is based upon and claims the benefit of priority from the corresponding Japanese Patent Application No. 2011-008393 filed on Jan. 19, 2011 and Japanese Patent Application No. 2011-008396 filed on Jan. 19, 2011, the entire contents of which are incorporated herein by reference.

BACKGROUND

The present disclosure relates to a toner dispersing mechanism, a developing device including the toner dispersing mechanism, and an image forming apparatus, the toner dispersing mechanism being mounted to an electrophotographic image forming apparatus such as a copier, a printer, and a facsimile, and dispersing toner to be replenished from a toner storage container such as a hopper and a container into a developing device.

Conventionally, for facilitation of maintenance, a developing device to be mounted to an image forming apparatus is filled in advance with a predetermined amount of toner, and the whole developing device is replaced after the toner is depleted. However, the developing device cannot be frequently replaced from an economic viewpoint, and hence a toner capacity is inevitably increased for performing image formation on somewhat many sheets. Thus, it is difficult to downsize the developing device configured as described above. Under the circumstance, in order to achieve downsizing of the developing device, there has been proposed a developing device of a type in which toner is supplied from an outside.

Disadvantageously, in the developing device of such a toner supply type, a lump of toner is sometimes replenished into the developing device when toner fluidity is reduced depending on use environments and the like. Thus, there is a risk that the mixing properties with respect to developer existing in the developing device is deteriorated and a developer thin layer to be formed on a developing roller is disturbed, with the result that image failures such as image-density unevenness and fogging occur.

Under the circumstance, there have been proposed various techniques for suppressing occurrence of the image failures through in-advance dispersion of the toner to be replenished into the developing device. For example, there has been known a developing device in which a matrix member (mesh) and a brush-like developer supply roller are arranged between a developer carrier and a developer storage portion. Further, there has been known another developing device including a toner-replenishing-port stirring member for stirring toner in a toner replenishing port of a toner hopper. Still further, there has been known a method in which a toner dispersing member formed of a core and a cylindrical foam member is arranged to close a replenishing port of a toner bottle, and toner is dropped little by little into a developing device by rotating the toner dispersing member.

Meanwhile, there has been known an image forming apparatus which includes an auxiliary stirring container for separately receiving toner to be replenished from a toner replenishing container and carrier to be replenished from a carrier replenishing container and for sufficiently mixing and stirring the toner and the carrier with use of a screw-like stirring-and-conveying member, and in which developer, which is stabilized in charging properties by being preliminarily mixed in the auxiliary stirring container, is supplied to the developing device.

However, as for the developing device in which the matrix member (mesh) and the brush-like developer supply roller are arranged between the developer carrier and the developer storage portion, in a case where toner has been aggregated depending on use environments or owing to mechanical stress, clogging of the mesh member and fusion of the toner are liable to occur, and hence it is difficult to replenish toner by a minute amount. Further, as for the developing device including the toner-replenishing-port stirring member for stirring toner in the toner replenishing port of the toner hopper, an advantage of smoothly conveying the toner by breaking a bridge formed by aggregation of the toner in the toner replenishing port can be expected. However, it is difficult to completely disperse the lump of toner, and hence the above-mentioned problem has not yet been completely solved even with this device.

Meanwhile, as for the method in which the toner dispersing member formed of the core and the cylindrical foam member is arranged to close the replenishing port of the toner bottle, and toner is dropped little by little into the developing device by rotating the toner dispersing member, the toner dispersing member is attached on the toner bottle side. Thus, the toner dispersing member is replaced simultaneously with replacement of the toner bottle, which leads to a problem of a cost increase. Further, the cylindrical foam member is used as the toner dispersing member, and hence toner clogs the foam member, which leads to another problem of deterioration of durability of the toner dispersing member.

Further, although the auxiliary stirring container including the screw-like stirring-and-conveying member has a function of efficiently mixing and stirring toner and carrier, an advantage of dispersing aggregated toner into particles cannot be expected. Thus, the auxiliary stirring container has not been usable as a toner dispersing mechanism.

SUMMARY

The present disclosure has been made in view of the above-mentioned problems, and has an object to provide a toner dispersing mechanism and a developing device provided with the toner dispersing mechanism, the toner dispersing mechanism capable of bringing toner to be replenished from a toner storage container into a dispersed state with a simple structure and supplying the dispersed toner into the developing device. Further, it is another object of the present disclosure to provide an image forming apparatus capable of effectively suppressing image failures such as density unevenness and fogging by mounting the toner dispersing mechanism and the developing device thereto.

In order to achieve the above-mentioned objects, a toner dispersing mechanism according to an aspect of the present disclosure is a toner dispersing mechanism arranged between a toner storage container and a developing device, for dispersing toner to be replenished from the toner storage container. The toner dispersing mechanism includes a housing, a toner dispersing member, and a projecting portion formed continuously at least at a part of an inner wall surface in a longitudinal direction of the housing. The housing includes a toner filling port communicating to the toner storage container, and a toner discharge port communicating to the developing device. The toner dispersing member includes a rotary shaft rotatably supported in the housing, and a large number of dispersing protrusions made of an elastic material and formed on an outer peripheral surface of the rotary shaft. The large number of dispersing protrusions face the part and come into contact with the projecting portion.

Further features and advantages of the present disclosure will become apparent from the description of embodiments given below.

DETAILED DESCRIPTION

Figure 1:
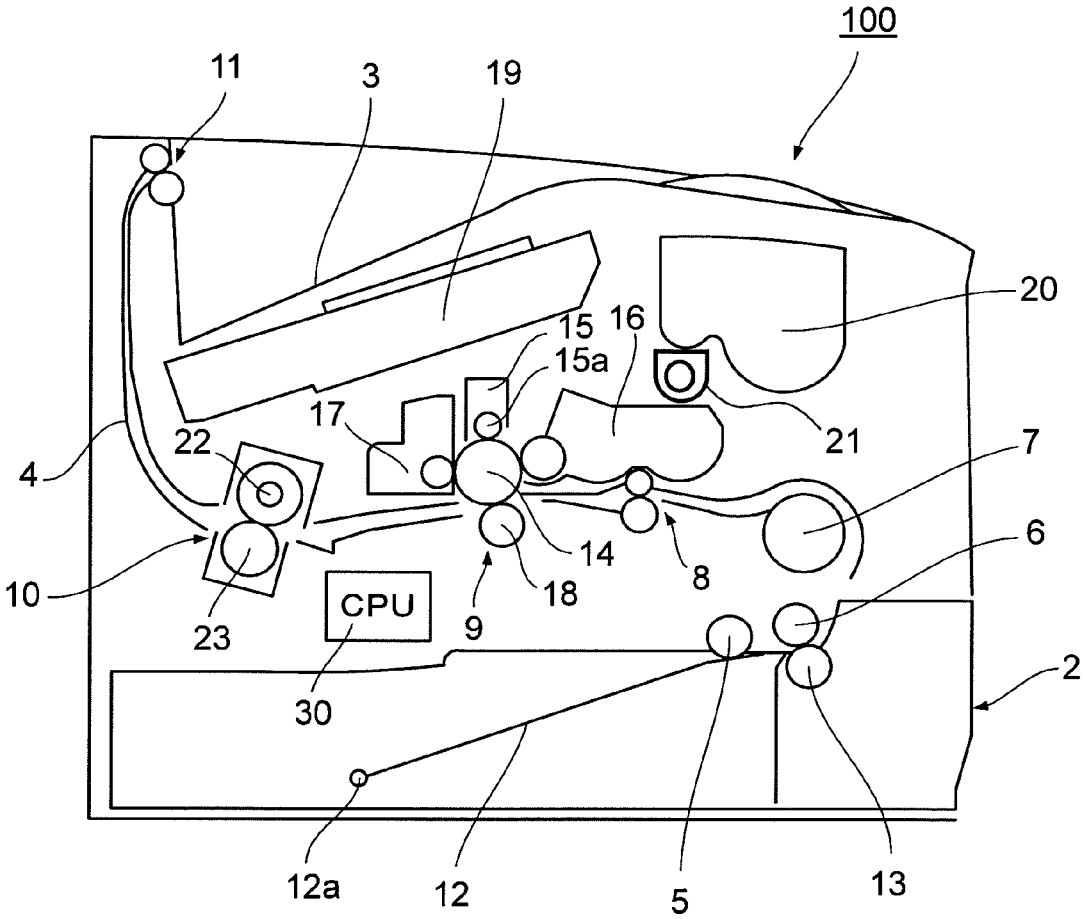
FIG. 1 is a schematic structural view of an overall structure of an image forming apparatus 100 of the present disclosure.

In the following, description is made of embodiments of the present disclosure with reference to the drawings. FIG. 1 is a schematic structural view of an overall structure of an image forming apparatus 100 to which a toner dispersing mechanism 21 and a developing device 16, which includes the toner dispersing mechanism 21, according to the present disclosure are mounted. A right side of FIG. 1 corresponds to a front side of the image forming apparatus 100. As illustrated in FIG. 1, in a lower portion of a main unit of the image forming apparatus 100, there is provided a sheet feeding cassette 2 for receiving stacked sheets. Above the sheet feeding cassette 2, there is formed a sheet conveyance path 4 extending substantially horizontally from the main-unit front side to a main-unit rear side and further extending upward to reach to a delivery portion 3 formed on a main-unit upper surface. Along the sheet conveyance path 4, there are arranged a pick-up roller 5, a feed roller 6, an intermediate conveyance roller 7, a registration roller pair 8, an image forming section 9, a fixing section 10, and a delivery roller pair 11 in the stated order from the upstream side. Further, in the image forming apparatus 100, there is arranged a control portion 30 (CPU) for controlling operations of the above-mentioned rollers, the image forming section 9, the fixing section 10, and the like.

The sheet feeding cassette 2 includes a sheet stacking plate 12 turnably supported with respect to the sheet feeding cassette 2 by a turning fulcrum 12*a* provided at a rear end portion in a sheet conveying direction. The sheets stacked on the sheet stacking plate 12 are pressed by the pick-up roller 5. Further, on a front side of the sheet feeding cassette 2, a retard roller 13 is disposed in press contact with the feed roller 6. When several sheets are simultaneously fed by the pick-up roller 5, the sheets are separated by the feed roller 6 and the retard roller 13 so that only an uppermost one of the sheets is conveyed.

Then, the sheet separated by the feed roller 6 and the retard roller 13 is switched in conveying direction by the intermediate conveyance roller 7 to the rear of the apparatus so as to be conveyed to the registration roller pair 8. The sheet conveyed to the registration roller pair 8 is fed to the image forming section 9 after being timed by the registration roller pair 8.

The image forming section 9 is provided to form a predetermined toner image onto a sheet by an electrophotographic process. The image forming section 9 includes a photosensitive drum 14 as an image carrier rotatably and axially supported in a clockwise direction in FIG. 1, a charging device 15, a developing device 16, a cleaning device 17 which are arranged around the photosensitive drum 14, a transfer roller 18 arranged to face the photosensitive drum 14 across the sheet conveyance path 4, and an exposure unit (LSU) 19 arranged above the photosensitive drum 14. A toner container 20 for replenishing toner to the developing device 16 is arranged above the developing device 16. A toner dispersing mechanism 21 for dispersing the toner to be replenished to the developing device 16 is arranged between the developing device 16 and the toner container 20.

The charging device 15 includes a conductive rubber roller 15*a* to which a power source (not shown) is connected, the conductive rubber roller 15*a* being arranged in abutment against the photosensitive drum 14. When the photosensitive drum 14 rotates, the conductive rubber roller 15*a* is held in contact with a surface of the photosensitive drum 14, and hence is rotated in accordance therewith. At this time, a predetermined voltage is applied to the conductive rubber roller 15*a*, to thereby uniformly charge the surface of the photosensitive drum 14.

Next, an electrostatic latent image based on input image data is formed on the photosensitive drum 14 by a laser beam from the exposure unit (LSU) 19. Then, the developing device 16 causes toner to adhere to the electrostatic latent image so as to form a toner image on the surface of the photosensitive drum 14. In accordance with a timing of formation of the toner image, the sheet is fed from the registration roller pair 8 to a transfer position formed at a nip portion between the photosensitive drum 14 and the transfer roller 18. Then, the toner image formed on the surface of the photosensitive drum 14 is transferred by the transfer roller 18 onto the sheet.

The sheet that has undergone transfer of the toner image is separated from the photosensitive drum 14 and conveyed to the fixing section 10. The fixing section 10 is arranged on a downstream side with respect to the image forming section 9 in the sheet conveying direction. The sheet that has undergone transfer of the toner image at the image forming section 9 is heated and pressed respectively by a heating roller 22 and a pressure roller 23 provided in press contact with the heating roller 22, which are provided in the fixing section 10. In this way, the toner image transferred onto the sheet is fixed.

The sheet that has undergone the image formation at the image forming section 9 and the fixing section 10 is delivered onto the delivery portion 3 by the delivery roller pair 11. Meanwhile, residual toner on the surface of the photosensitive drum 14 even after the transfer is removed by the cleaning device 17. Then, the photosensitive drum 14 is recharged by the charging device 15, and image formation is sequentially performed as described above.

Figure 2:
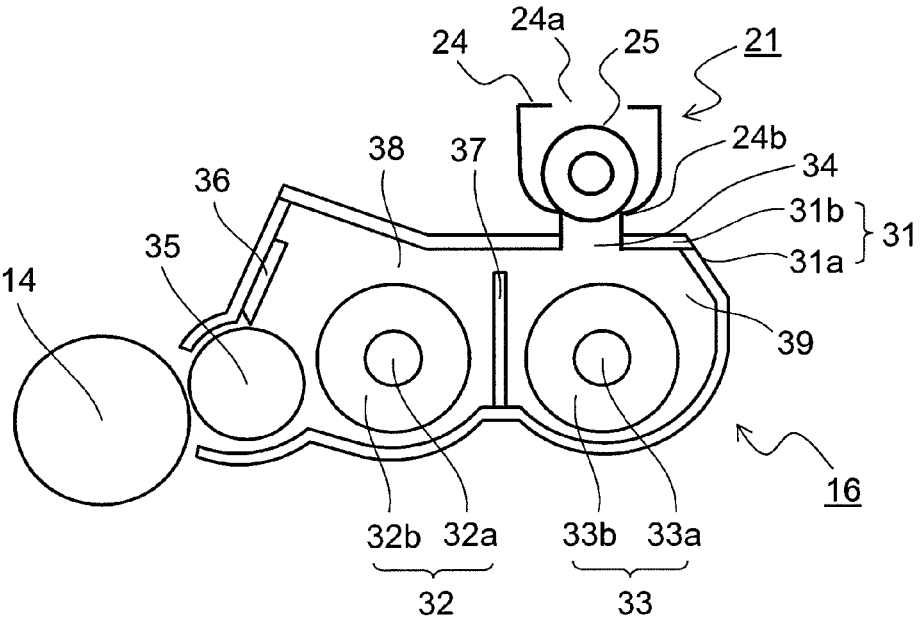
FIG. 2 is a side sectional view (sectional view taken along the arrows X-X' in FIG. 3) of a developing device 16 including a toner dispersing mechanism 21 according to a first embodiment of the present disclosure.
Figure 3:
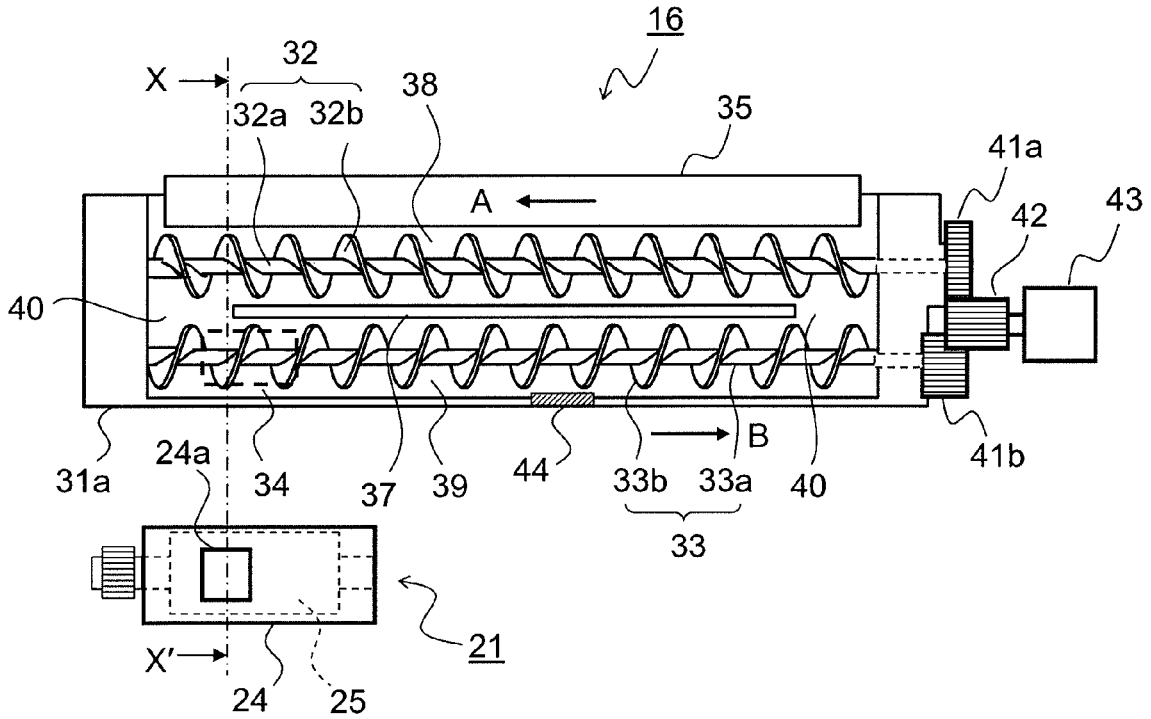
FIG. 3 is a plan view in which the developing device 16 including the toner dispersing mechanism 21 according to the first embodiment is viewed from above.

Next, with reference to FIGS. 2 and 3, detailed description is made of the developing device 16 including the toner dispersing mechanism 21 of the present disclosure. FIG. 2 is a side sectional view of the developing device 16 of the present disclosure, and FIG. 3 is a plan view in which the developing device 16 is viewed from above. Note that, the cross-section of FIG. 2 corresponds to a sectional view taken along the arrows X-X' in FIG. 3, and FIG. 3 illustrates a state in which a cover 31*b* is removed for the sake of convenience in illustration.

As illustrated in FIGS. 2 and 3, the developing device 16 includes a developing container 31 formed of a container main unit 31*a* for storing a two-component developer including non-magnetic toner and a magnetic carrier and the cover 31*b* for sealing the container main unit 31*a* so as to prevent the developer stored in the container main unit 31*a* from leaking to an outside. In the developing container 31, there are provided a first stirring-and-conveying screw 32, a second stirring-and-conveying screw 33, a developing roller 35, and a regulating blade 36.

An inside of the container main unit 31*a* is divided by a partition plate 37 extending in a longitudinal direction into a first storage chamber 38 and a second storage chamber 39. The first stirring-and-conveying screw 32 is disposed in the first storage chamber 38, and the second stirring-and-conveying screw 33 is disposed in the second storage chamber 39. Further, as illustrated in FIG. 3, the partition plate 37 is not provided up to both right and left end portions of the container main unit 31*a*, and those portions serve as paths (developer exchange portions) 40 through which the developer moves between the first storage chamber 38 and the second storage chamber 39.

The first stirring-and-conveying screw 32 and the second stirring-and-conveying screw 33 are respectively formed of rotary shafts 32*a* and 33*a* and helical blades 32*b* and 33*b* formed integrally with outer peripheral surfaces thereof, and rotatably and axially supported in the container main unit 31*a* so as to be substantially parallel to each other. The first stirring-and-conveying screw 32 and the second stirring-and-conveying screw 33 rotates in predetermined directions so as to convey the developer in the first storage chamber 38 into a direction of an arrow A and convey the developer in the second storage chamber 39 into a direction of an arrow B. Further, in order that toner can be replenished into the container main unit 31*a* in accordance with a detection result from a toner concentration sensor 44 described later, the cover 31*b* includes a toner replenishing port 34 through which toner is supplied from the toner container 20 (refer to FIG. 1).

Further, drive input gears 41*a* and 41*b* are respectively coupled to the rotary shafts 32*a* and 33*a* of the first stirring-and-conveying screw 32 and the second stirring-and-conveying screw 33, and a motor 43 is connected to the drive input gears 41*a* and 41*b* through intermediation of a drive output gear 42. The drive input gears 41*a* and 41*b*, the drive output gear 42, and the motor 43 drive to rotate the first stirring-and-conveying screw 32 and the second stirring-and-conveying screw 33 in the predetermined directions. In this way, the developer is conveyed in the first storage chamber 38 and the second storage chamber 39, and as described above, circulates in the first storage chamber 38 and the second storage chamber 39 through the paths 40 provided at both the right and left end portions of the container main unit 31*a*.

The developing roller 35 is rotatably and axially supported in the first storage chamber 38 so as to be substantially parallel to the first stirring-and-conveying screw 32 and the second stirring-and-conveying screw 33, and the motor 43 is connected also to the developing roller 35 through intermediation of a gear train (not shown). A magnet roller having an inner surface to which a magnetic-field generating member (not shown) formed of a permanent magnet is fixed is used as the developing roller 35. When the developing roller 35 is rotated in accordance with rotation of the photosensitive drum 14, a magnetic force of the magnetic-field generating member causes the developer to adhere to (be carried on) a surface of the developing roller 35. In this way, a developer layer is formed.

Then, in a predetermined developing region, toner in the developer adhering to the developing roller 35 adheres to a photosensitive layer by being caused to fly to the photosensitive drum 14 due to potential difference between a surface potential of the photosensitive drum 14 and a developing bias applied to the developing roller 35. In this way, a toner image is formed on the surface of the photosensitive drum 14. Note that, drive means other than the motor 43 may be connected to the developing roller 35 so that the developing roller 35 is independently driven.

The regulating blade 36 is provided to regulate an amount of toner to be supplied to the photosensitive drum 14, that is, a developer adhesion amount with respect to the developing roller 35. As a material for the regulating blade 36, a non-magnetic stainless (SUS) such as SUS303 is used, and the regulating blade 36 is disposed so that a predetermined gap is formed between a distal end of the regulating blade 36 and the developing roller 35. With the gap between the regulating blade 36 and the developing roller 35, the developer adhesion amount with respect to the developing roller 35 is regulated. In this way, a thin developer layer having a thickness of several hundred microns is formed on the surface of the developing roller 35.

The toner concentration sensor 44 is arranged on an inner wall surface of the second storage chamber 39. As the toner concentration sensor 44, there is used a magnetic permeability sensor for detecting a magnetic permeability of the two-component developer formed of toner and a magnetic carrier in the container main unit 31*a*. Here, the term "toner concentration" represents a ratio of the toner to the magnetic carrier in the developer. In this embodiment, the toner concentration sensor 44 detects the magnetic permeability of the developer and outputs a voltage value corresponding to a detection result therefrom to the control portion 30 (refer to FIG. 1). The control portion 30 determines the toner concentration based on the output value from the toner concentration sensor 44.

The sensor output value varies in accordance with the toner concentration. Specifically, the ratio of the toner with respect to the magnetic carrier becomes higher as the toner concentration becomes higher, and hence a percentage of the non-magnetic toner increases, with the result that the output value decreases. Meanwhile, the ratio of the toner with respect to the carrier becomes lower as the toner concentration becomes lower, and hence a percentage of the magnetic carrier increases, with the result that the output value increases.

The toner dispersing mechanism 21 is formed of a housing 24 formed integrally with the cover 31*b* of the developing device 16, and the toner dispersing member 25 rotatably supported in the housing 24. A toner filling port 24*a* is formed through an upper surface of the housing 24, and a toner discharge port 24*b* communicating to the toner replenishing port 34 of the developing device 16 is formed through a lower surface of the housing 24.

Note that, the term "dispersion" used herein represents a state in which the toner has been powdered into particles, which is clearly distinguished from "mixture" effected by screws and helixes.

Figure 4:
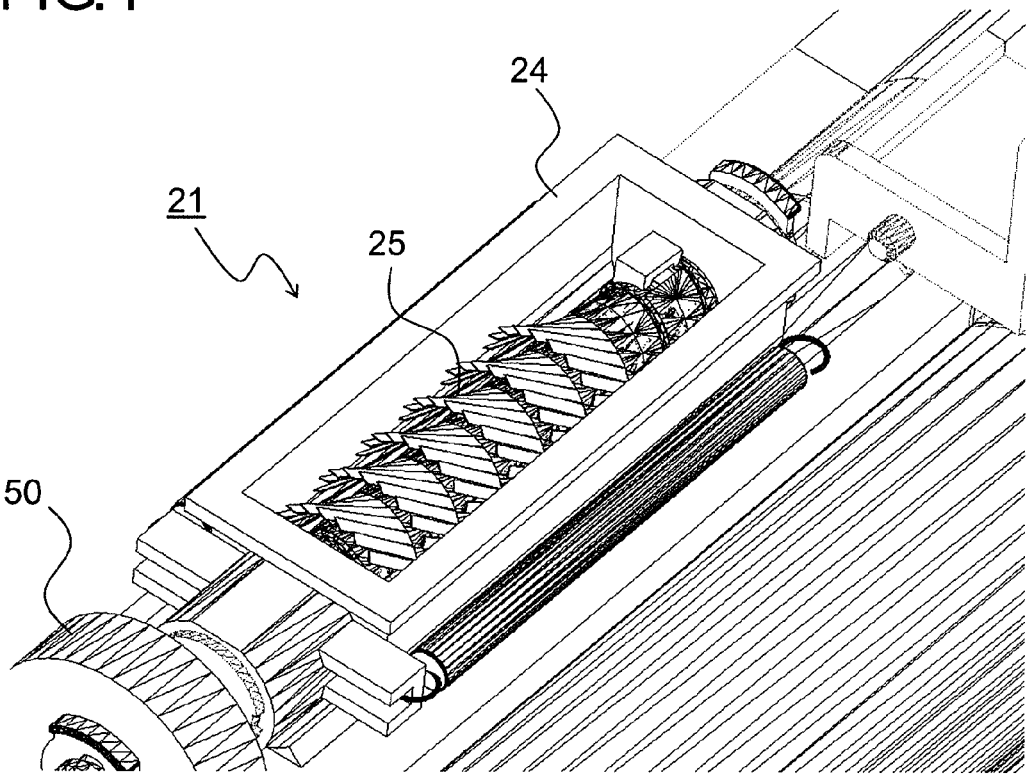
FIG. 4 is a perspective view in which the toner dispersing mechanism 21 according to the first embodiment is viewed from above.
Figure 5:
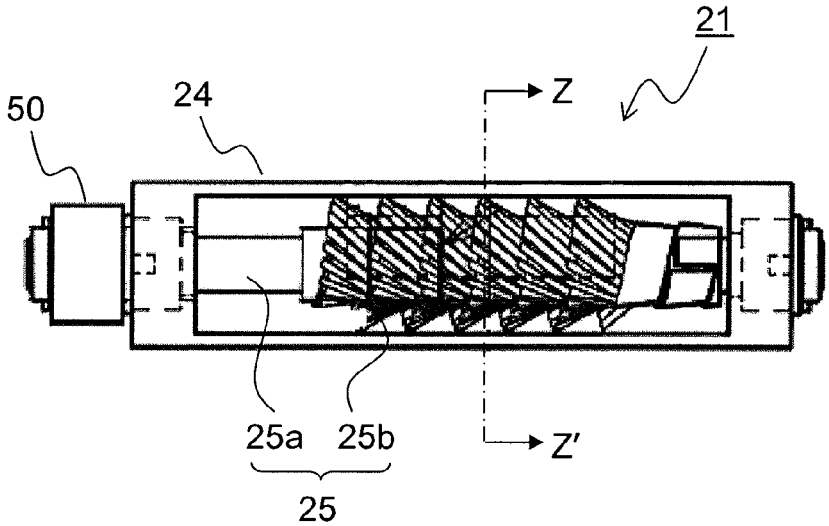
FIG. 5 is a plan view of the toner dispersing mechanism 21 according to the first embodiment.

FIGS. 4 and 5 are respectively a perspective view and a plan view of the toner dispersing mechanism 21 according to the first embodiment of the present disclosure. Description is made of a structure of the toner dispersing mechanism 21 with reference to FIGS. 4 and 5 together with FIGS. 2 and 3. The toner dispersing mechanism 21 is formed of the housing 24 and the toner dispersing member 25 rotatably supported in the housing 24. Note that, for the sake of convenience in illustration, FIGS. 4 and 5 illustrate a state in which the upper surface of the housing 24 is opened so that an inside of the housing 24 is visible.

The toner filling port 24*a* is formed through the upper surface of the housing 24, and the toner discharge port 24*b* communicating to the toner replenishing port 34 of the developing device 16 is formed through the lower surface of the housing 24. When a predetermined amount of toner is injected from the toner filling port 24*a* into the toner dispersing mechanism 21 in accordance with an output of the toner concentration sensor 44, a lump of the toner is dispersed by rotation of the toner dispersing member 25 and then discharged from the toner discharge port 24*b*, with the result of being replenished into the developing device 16 through the toner replenishing port 34. Further, the toner filling port 24*a* is including a shutter member (not shown) which opens in conjunction with attachment of the toner container 20 and closes in conjunction with detachment of the toner container 20.

The toner dispersing member 25 is including a large number of dispersing protrusions 25*b* made of an elastic material and formed on an outer peripheral surface of the rotary shaft 25*a*. One end of the rotary shaft 25*a* extends up to an outside of the housing 24, and a drive input gear 50 is fixed thereto. The drive input gear 50 is coupled to a drive mechanism (not shown) through intermediation of a gear train. Further, distal ends of the dispersing protrusions 25*b* are arranged in contact with an opening edge of the toner discharge port 24*b*.

Figure 6:
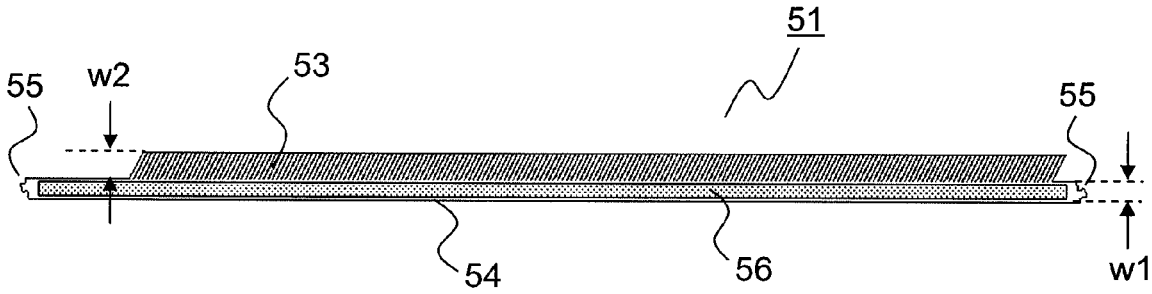
FIG. 6 is a developed view illustrating an example of a first film member 51 used to form dispersing protrusions 25*b* of a toner dispersing member 25 to be used in the toner dispersing mechanism 21 according to the first embodiment.
Figure 7:
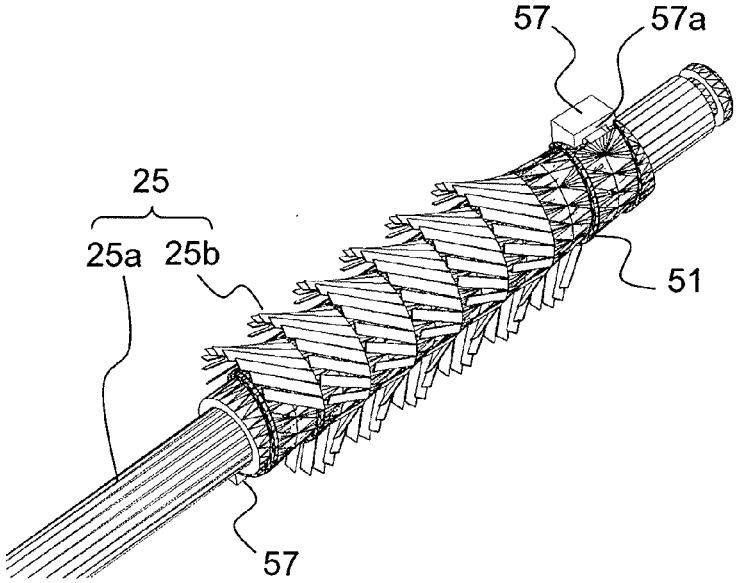
FIG. 7 is a perspective view of the toner dispersing member 25 to be used in the toner dispersing mechanism 21 according to the first embodiment.

FIG. 6 is a developed view illustrating an example of a first film member 51 used to form the dispersing protrusions 25*b* of the toner dispersing member 25 to be used in the toner dispersing mechanism 21 according to the first embodiment. FIG. 7 is a perspective view of the toner dispersing member 25 having the dispersing protrusions 25*b* formed of the first film member 51 illustrated in FIG. 6, which is helically wrapped around the rotary shaft 25*a*. The dispersing protrusions 25*b* of the toner dispersing member 25 illustrated in FIG. 7 are formed of the first film member 51 having a ribbon-like shape, including a large number of cuts 53 formed on one side in the longitudinal direction (upper side of FIG. 6) and a fixation portion 54 formed of a part free from the cuts 53, and helically wrapped around the outer peripheral surface of the rotary shaft 25*a*, with the cuts 53 being directed outward.

As illustrated in FIG. 6, the cuts 53 are formed not perpendicularly but obliquely to the longitudinal direction of the first film member 51. With this, when the first film member 51 is wrapped around the outer peripheral surface of the rotary shaft 25*a*, the parts including the cuts 53 rise at certain angles with respect to the rotary shaft 25*a*. Thus, the dispersing protrusions 25*b* can be formed uniformly and easily without being spread by hands. The rising angles of the dispersing protrusions 25*b* with respect to the rotary shaft 25*a* can be arbitrarily adjusted by the angles of the cuts 53.

Further, engagement protrusions 55 are formed at both end portions of the first film member 51, and engagement portions 57 with which the engagement protrusions 55 are to be engaged are projected at two points on the outer peripheral surface of the rotary shaft 25*a*. Further, a double-faced tape 56 is applied over the entire longitudinal region of the fixation portion 54 of the first film member 51. In order to assembly the toner dispersing member 25, first, the engagement protrusion 55 at one end of the first film member 51 is inserted into a slit 57*a* of corresponding one of the engagement portions 57. Then, the first film member 51 is attached with the double-faced tape 56 in a manner of being wrapped around the rotary shaft 25*a*. Lastly, the engagement protrusion 55 at another end is inserted into a slit 57*a* of another of the engagement portions 57. In this way, the first film member 51 can be easily fixed to the rotary shaft 25*a*.

According to the structure in this embodiment, when the toner dispersing member 25 is rotated at an appropriate timing with respect to injection of toner from the toner container 20 (refer to FIG. 1) into the toner filling port 24*a*, the distal ends of the dispersing protrusions 25*b* rock by being brought into contact with an inner surface of the housing 24 and the opening edge of the toner discharge port 24*b*. By the rocking of the dispersing protrusions 25*b*, a lump of toner that has entered the housing 24 from the toner filling port 24*a* can be efficiently dispersed into particles.

Further, the dispersing protrusions 25*b* are formed of the first film member 51, and hence the dispersing protrusions 25*b* can be easily formed on the outer peripheral surface of the rotary shaft 25*a*. Further, bristle loss or sponge tear-off does not occur unlike the cases of using a bristle brush roller and a sponge roller. Thus, the toner dispersing member 25 excellent in durability is obtained at low cost. In addition, there is no risk that foreign matter derived from the toner dispersing member 25 enters the developing container 31, and hence image failures such as occurrence of an image with white streaks, which are caused by foreign matter stuck in the gap between the regulating blade 36 and the developing roller 35, are effectively prevented. It is preferred that the first film member 51 be made of a material such as a PET film and a urethane sheet which are excellent in flexibility and restorability (elasticity).

Figure 8:
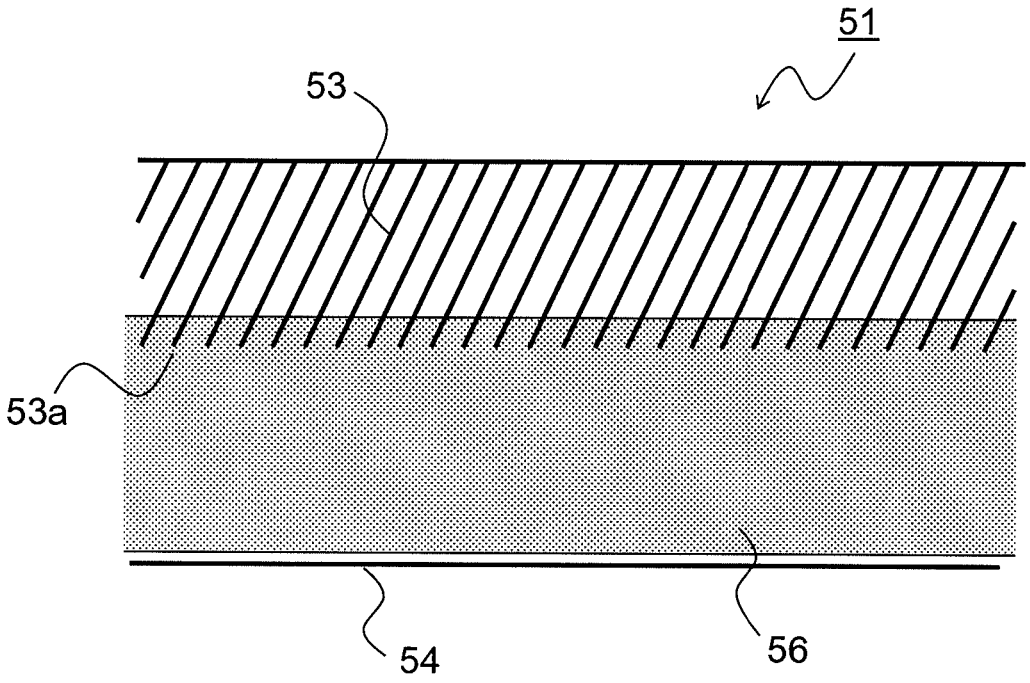
FIG. 8 is a partially enlarged view of the first film member 51, illustrating a state in which a double-faced tape 56 is applied in a manner of being overlapped on proximal end portions 53*a* of cuts 53.

Further, when the first film member 51 is wrapped around the rotary shaft 25*a* so as to form the toner dispersing member 25, load is applied to the dispersing protrusions 25*b*, which leads to a risk that the cuts 53 further split and the dispersing protrusions 25*b* are torn off. As a countermeasure, when the double-faced tape 56 is applied to the fixation portion 54, as illustrated in FIG. 8, it is preferred that the double-faced tape 56 be applied in a manner of being overlapped on proximal end portions 53*a* of the cuts 53. With application in such a manner, the proximal end portions 53*a* of the cuts 53 are reinforced by the double-faced tape 56. Thus, the dispersing protrusions 25*b* are prevented from being torn off.

Figure 9:
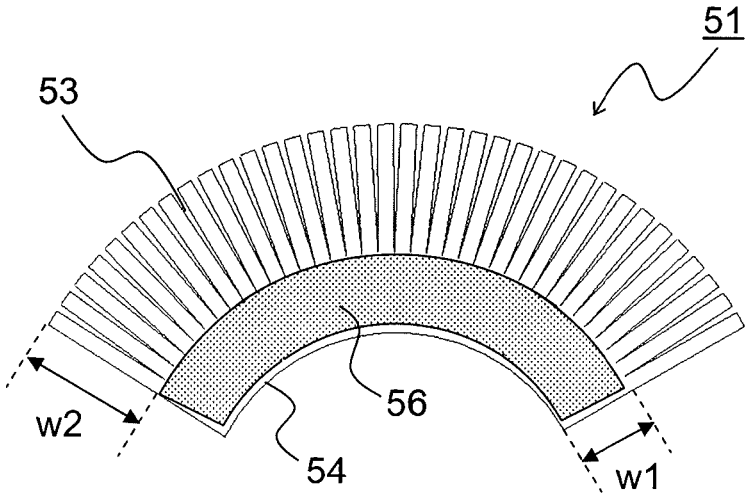
FIG. 9 is a developed view illustrating another example of the first film member 51 used to form the dispersing protrusions 25*b* of the toner dispersing member 25 to be used in the toner dispersing mechanism 21 according to the first embodiment.
Figure 10:
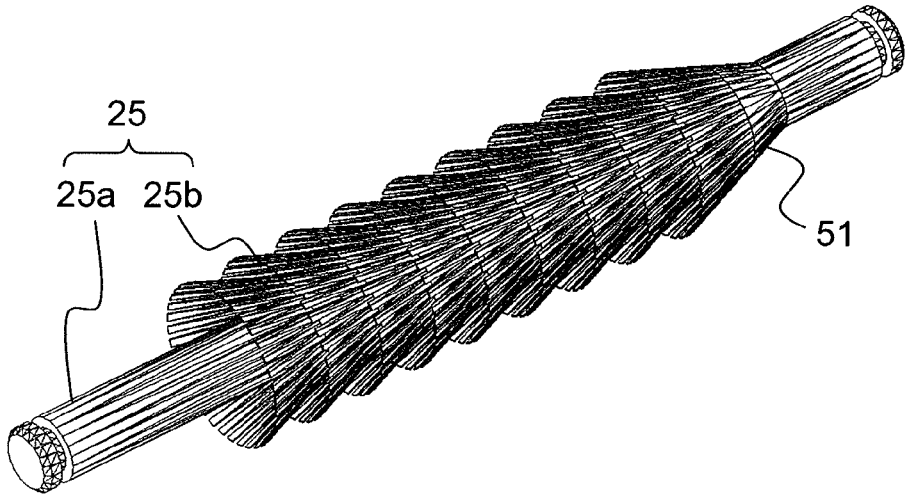
FIG. 10 is a perspective view of the toner dispersing member 25 to be used in the toner dispersing mechanism 21 according to the first embodiment, which is including the dispersing protrusions 25*b* formed of a plurality of first film members 51 illustrated in FIG. 9.

FIG. 9 is a developed view illustrating another example of the first film member 51 used to form the dispersing protrusions 25*b* of the toner dispersing member 25. FIG. 10 is a perspective view of the toner dispersing member 25 having the dispersing protrusions 25*b* formed of the plurality of first film members 51 illustrated in FIG. 9, which are helically wrapped around the rotary shaft 25*a*. The first film member 51 illustrated in FIG. 9 includes the large number of cuts 53 formed inward from an outer peripheral edge of a fan-like film, and includes the fixation portion 54 formed of an inner peripheral edge portion free from the cuts 53, the fixation portion 54 being applied with the double-faced tape 56. The dispersing protrusions 25*b* of the toner dispersing member 25 illustrated in FIG. 10 are formed of a plurality of first film members 51 (nine in this case) conically wrapped around the rotary shaft 25*a* at a predetermined pitch.

As also for the toner dispersing member 25 illustrated in FIG. 10, similarly to the toner dispersing member 25 illustrated in FIG. 7, there is no risk that foreign matter derived from the toner dispersing member 25 enters the developing container 31, and hence image failures such as occurrence of an image with white streaks are effectively prevented.

Further, the dispersing protrusions 25*b* of the toner dispersing member 25 illustrated in FIG. 10 are formed of the plurality of first film members 51, and hence thickness and hardness (elasticity) of each of the first film members 51 forming the dispersing protrusions 25*b* can be independently changed in one toner dispersing member 25. Accordingly, dispersion properties in the longitudinal direction of the toner dispersing member 25 can be arbitrarily adjusted. Further, when the dispersing protrusions 25*b* are partially deteriorated through a temporal change and the like, it suffices that only the first film member 51 corresponding to the deteriorated part be replaced. Thus, maintenance properties of the toner dispersing member 25 are enhanced. In addition, in order to prevent the dispersing protrusions 25*b* from being torn off, it is preferred that the double-faced tape 56 be applied also to the first film member 51 of FIG. 9 in a manner of being overlapped on the proximal end portions 53*a* of the cuts 53 similarly to the first film member 51 of FIG. 8.

Figure 11:
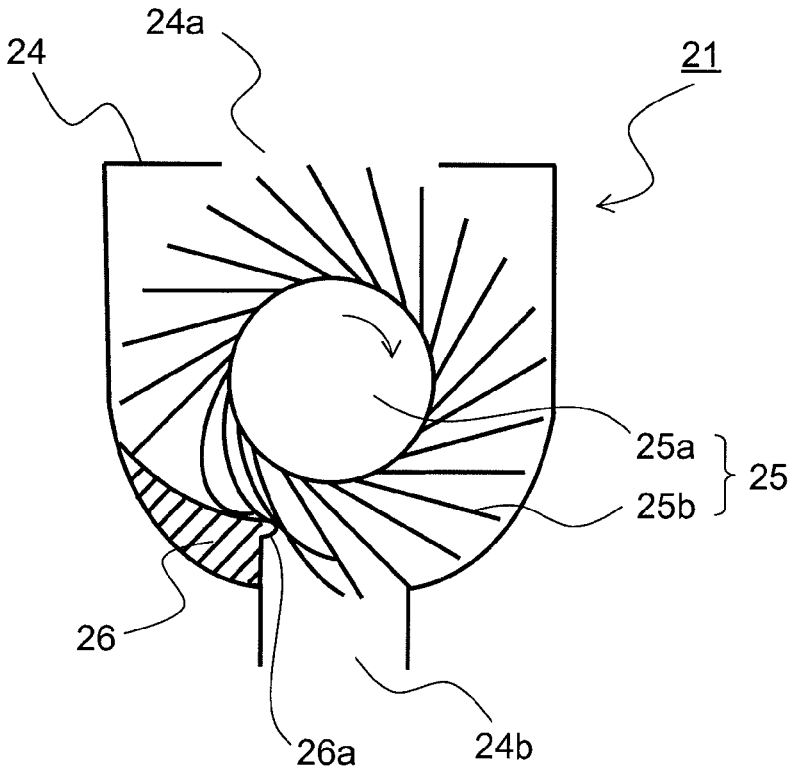
FIG. 11 is a front sectional view (sectional view taken along the arrows Z-Z' in FIG. 5) of the toner dispersing mechanism 21 according to the first embodiment.

FIG. 11 is a front sectional view (sectional view taken along the arrows Z-Z' in FIG. 5) of the toner dispersing mechanism 21 according to the first embodiment. On an inner wall surface of the housing 24, a projecting portion 26 (cross-hatched part in FIG. 11) is formed in a vicinity of a downstream side with respect to the toner discharge port 24*b* in a rotational direction of the toner dispersing member 25 (direction of the arrow in FIG. 11). The projecting portion 26 is formed continuously at least at a part at which the dispersing protrusions 25*b* face in the longitudinal direction of the housing 24 (direction perpendicular to the drawing sheet of FIG. 11). At an upstream end portion of the projecting portion 26, there is formed a protrusion 26*a* projecting to an upstream side in the rotational direction of the toner dispersing member 25.

When the toner dispersing member 25 rotates in the direction of the arrow in FIG. 11, the dispersing protrusions 25*b* sequentially come into contact with the projecting portion 26 from the protrusion 26*a* to be elastically deformed, and are radially deflected. When the toner dispersing member 25 further rotates, the radially deflected dispersing protrusions 25*b* are sequentially separated from the projecting portion 26, and return to an original state by a restoring force.

When the dispersing protrusions 25*b* restore from the deflected state, toner embraced among the dispersing protrusions 25*b* and lightly aggregated is splashed, and hence the toner dispersing member 25 rotates without toner clogging. Thus, it is possible to effectively suppress a decrease of an amount of toner to be conveyed (dropped) from the toner discharge port 24*b*, a reduction of the dispersing effect, and an increase of rotational torque.

Further, the protrusion 26*a* is formed at the upstream end portion of the projecting portion 26. Thus, when the toner dispersing member 25 rotates, a part near a central portion of each of the dispersing protrusions 25*b* comes into contact with the protrusion 26*a* ahead of the distal end portion thereof. As a result, the dispersing protrusion 25*b* greatly deforms from the central portion to a root part, and greatly rocks at the time of being separated from the projecting portion 26 and returning to the original state.

Although the protrusion 26*a* thus formed is not particularly limited in height, in order to sufficiently curve the dispersing protrusion 25*b* from the root part, it is preferred to form the protrusion 26*a* so that a distance from the inner wall surface of the housing 24 to the protrusion 26*a* is 50% or more of a distance from the inner wall surface of the housing 24 to an attachment surface for the dispersing protrusions 25*b* (outer peripheral surface of the rotary shaft 25*a*). With this, the root side part relative to the central portion of the dispersing protrusion 25*b* first comes into contact with the protrusion 26*a*, and hence the dispersing protrusions 25*b* can be sufficiently curved.

Figure 12:
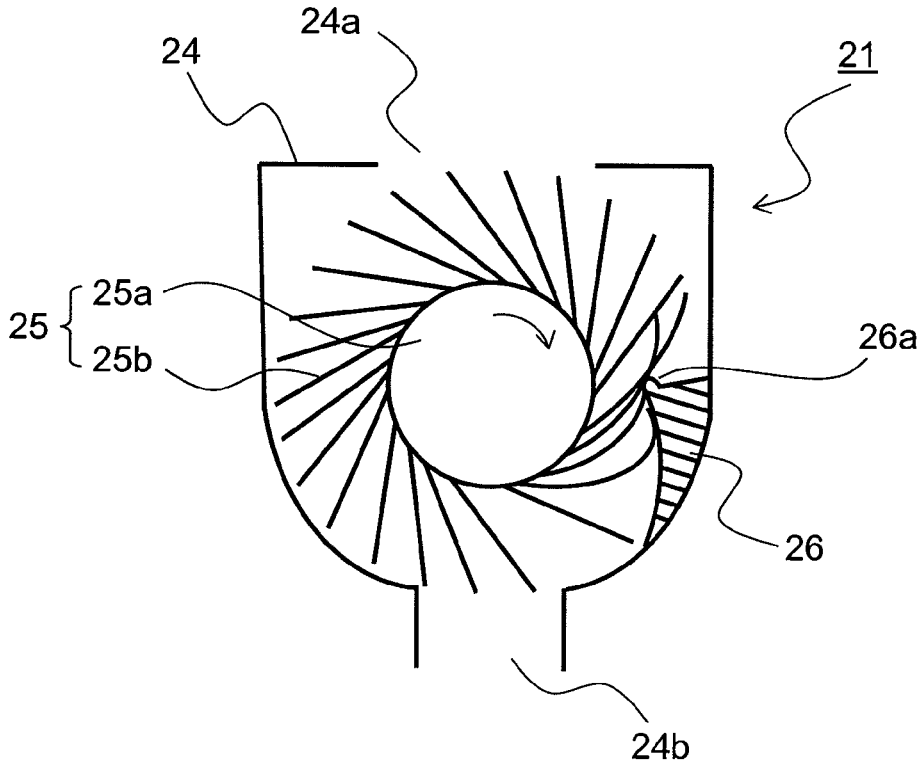
FIG. 12 is a front sectional view illustrating a modification example of the toner dispersing mechanism 21 according to the first embodiment.
Figure 13:
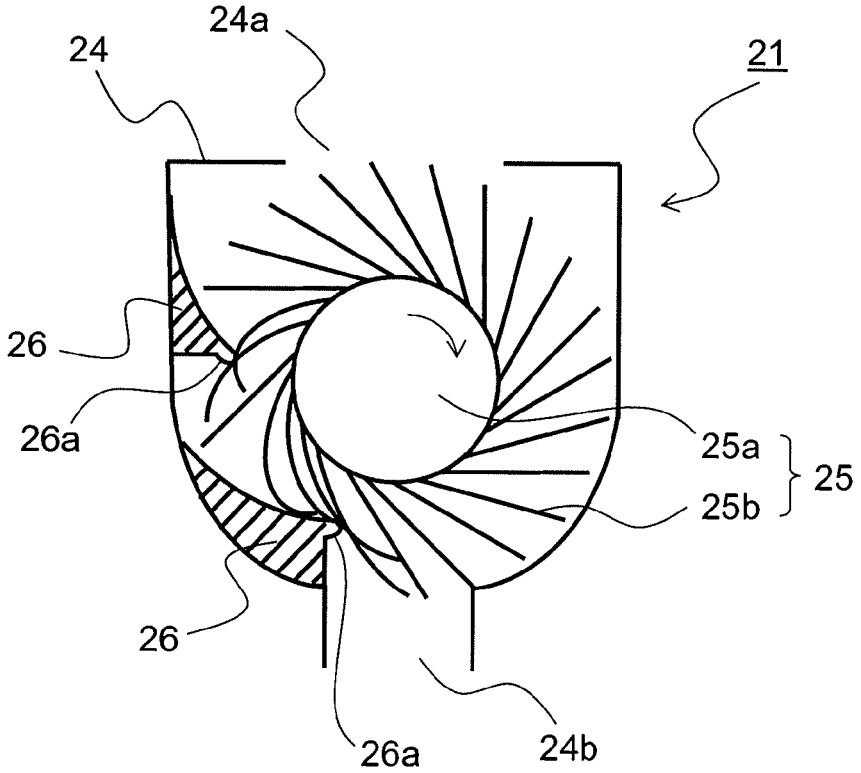
FIG. 13 is a front sectional view illustrating another modification example of the toner dispersing mechanism 21 according to the first embodiment.

Note that, the arrangement position of the projecting portion 26 is not limited to the vicinity of the downstream side of the toner discharge port 24*b*, and the projecting portion 26 may be provided at any position on the inner wall surface of the housing 24. For example, as illustrated in FIG. 12, the projecting portion 26 may be provided on an upstream side of the toner discharge port 24*b*. However, when the projecting portion 26 is provided in the vicinity of the downstream side of the toner discharge port 24*b* as illustrated in FIG. 11, the toner splashed by rocking of the dispersing protrusions 25*b* slides along an upper surface of the projecting portion 26 to drop into the toner discharge port 24*b*. Thus, the toner can be suppressed from accumulating in the housing 24. Further, as illustrated in FIG. 13, a plurality of projecting portions 26 may be provided at a plurality of points on the inner wall surface of the housing 24.

Next, description is made of a modification example of the toner dispersing member 25 to be used in the toner dispersing mechanism 21 according to the first embodiment. In this modification example, on the outer peripheral surface of the rotary shaft 25*a* of the toner dispersing member 25, there is provided a first support member 27 (refer to FIG. 16) for raising the dispersing protrusions 25*b* from the rotary shaft 25*a* side.

Figure 14:
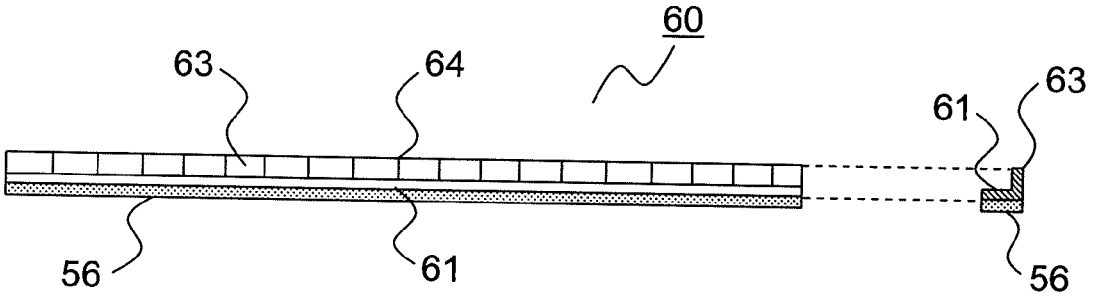
FIG. 14 is a developed view illustrating an example of a second film member 60 used to form a first support member 27 for the toner dispersing member 25 to be used in the toner dispersing mechanism 21 according to the first embodiment.
Figure 15:
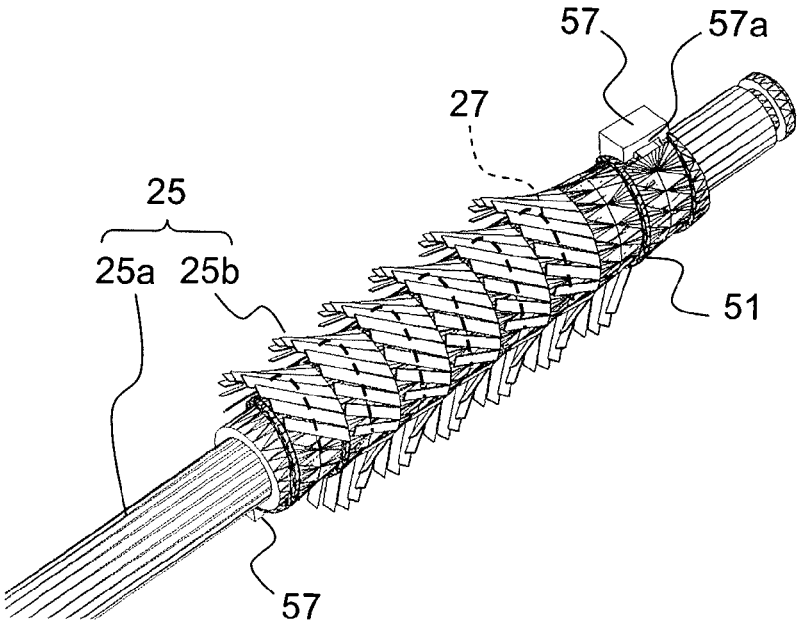
FIG. 15 is a perspective view of the toner dispersing member 25 having the dispersing protrusions 25*b* and the first support member 27 respectively formed of the first film member 51 illustrated in FIG. 6 and the second film member 60 illustrated in FIG. 14, which are helically wrapped around a rotary shaft 25*a*.
Figure 16:
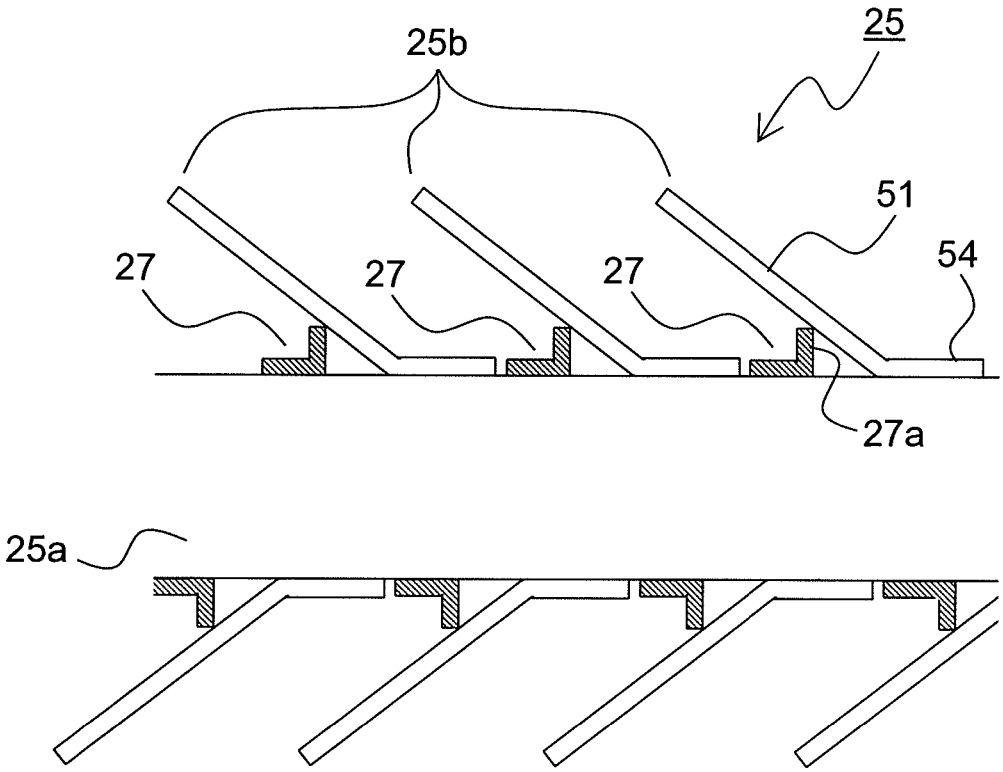
FIG. 16 is a partial sectional view of the toner dispersing member 25 having the dispersing protrusions 25*b* and the first support member 27 respectively formed of the first film member 51 illustrated in FIG. 6 and the second film member 60 illustrated in FIG. 14, which are helically wrapped around the rotary shaft 25*a*.

FIG. 14 is a developed view illustrating an example of a second film member 60 used to form the first support member 27 of the toner dispersing member 25 according to the above-mentioned modification example. FIGS. 15 and 16 are respectively a perspective view and a partial sectional view of the toner dispersing member 25 having the dispersing protrusions 25*b* and the first support member 27 respectively formed of the first film member 51 illustrated in FIG. 6 and the second film member 60 illustrated in FIG. 14, which are helically wrapped around the rotary shaft 25*a*.

The ribbon-like first film member 51 used to form the dispersing protrusions 25*b* has the same structure as that illustrated in FIG. 6.

As illustrated in FIG. 14, the ribbon-like second film member 60 used to form the first support member 27 includes a second fixation portion 61 to be fixed to the rotary shaft 25*a* and a support portion 63 provided substantially perpendicularly upright on one side (upper side of FIG. 14) in the longitudinal direction of the second fixation portion 61. The support portion 63 includes cuts 64 at a fixed interval, and the support portion 63 rises substantially perpendicularly to the rotary shaft 25*a* when the second film member 60 is wrapped along the rotary shaft 25*a*. Further, similarly to the first fixation portion 54 of the first film member 51, the double-faced tape 56 is applied over the entire longitudinal region of the second fixation portion 61.

In order to assembly the toner dispersing member 25, first, the second fixation portion 61 is attached with the double-faced tape 56 in a manner of helically wrapping the second film member 60 around the outer peripheral surface of the rotary shaft 25*a* at a predetermined pitch so that the support portion 63 rises. In this way, the first support member 27 is formed. Next, the engagement protrusion 55 at the one end of the first film member 51 is inserted into the slit 57*a* of corresponding one of the engagement portions 57. Then, the first fixation portion 54 is attached with the double-faced tape 56 in a manner of helically wrapping the first film member 51 around the outer peripheral surface of the rotary shaft 25*a* along the second film member 60, with the cuts 53 being directed outward. Lastly, the engagement protrusion 55 at the another end is inserted into the slit 57*a* of the another of the engagement portions 57 so that the first film member 51 is fixed to the rotary shaft 25*a*. In this way, the toner dispersing member 25 as illustrated in FIG. 15 is assembled.

In this modification example, as illustrated in FIG. 16, the first support member 27 is arranged on an inner side of the dispersing protrusions 25*b*, and hence a force of raising the dispersing protrusions 25*b* at a predetermined angle from the inner side (rotary shaft 25*a* side) acts due to an elastic force of the first support member 27. Thus, the dispersing protrusions 25*b* are suppressed from falling inward even when the dispersing protrusions 25*b* are brought into contact with the inner wall surface and the projecting portion 26 of the housing 24 by rotation of the toner dispersing member 25. As a result, toner is effectively suppressed from being embraced among the dispersing protrusions 25*b* that have fallen inward and being lightly aggregated.

Figure 17:
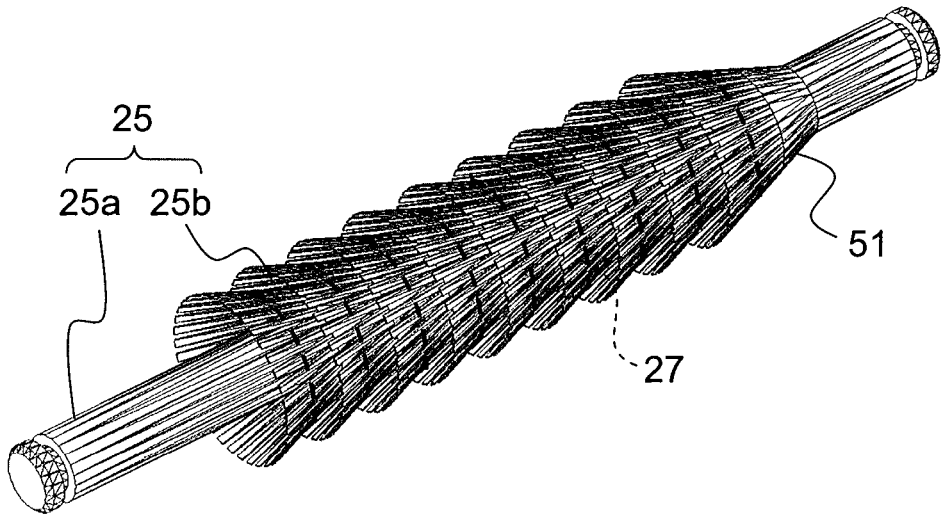
FIG. 17 is a perspective view of the toner dispersing member 25 having the dispersing protrusions 25*b* and the first support members 27 which are respectively formed of a plurality of first film members 51 illustrated in FIG. 9 and a plurality of second film members 60 illustrated in FIG. 14, which are annularly wrapped around the rotary shaft 25*a*.

FIG. 17 is a perspective view of the toner dispersing member 25 having the dispersing protrusions 25*b* and the first support members 27 respectively formed of the first film member 51 illustrated in FIG. 9 and the second film member 60 illustrated in FIG. 14, which are wrapped around the rotary shaft 25*a*. The dispersing protrusions 25*b* of the toner dispersing member 25 illustrated in FIG. 17 are formed of a plurality of fan-like first film members 51 as illustrated in FIG. 9 (nine in this case), which are conically wrapped around the rotary shaft 25*a* at a predetermined pitch. Further, the first support members 27 are respectively formed of the second film members 60 illustrated in FIG. 14, which are provided as many as the first film members 51 and annularly wrapped around the rotary shaft 25*a* at the same pitch as that of the first film members 51.

As also for the toner dispersing member 25 illustrated in FIG. 17, similarly to the toner dispersing member 25 illustrated in FIG. 15, there is no risk that foreign matter derived from the toner dispersing member 25 enters the developing container 31, and hence failures such as occurrence of an image with white streaks are effectively prevented. Further, the first support members 27 suppress the dispersing protrusions 25*b* from falling into a direction of the rotary shaft 25*a*, and hence toner is suppressed from being embraced among the dispersing protrusions 25*b*.

Figure 18:
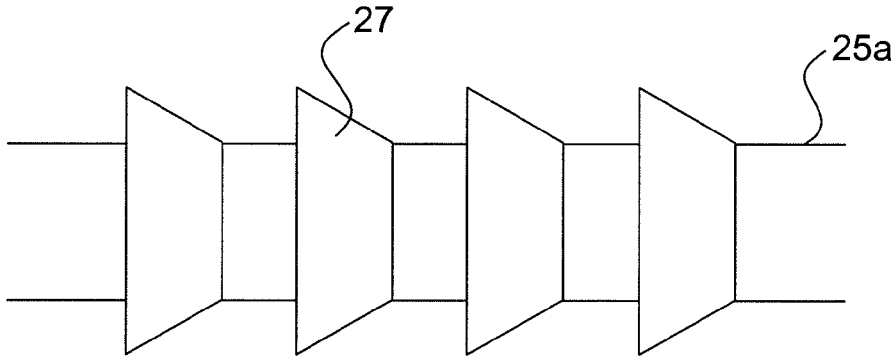
FIG. 18 is a partial side view of the rotary shaft 25*a* to be used for the toner dispersing member 25 illustrated in FIG. 17.
Figure 19:
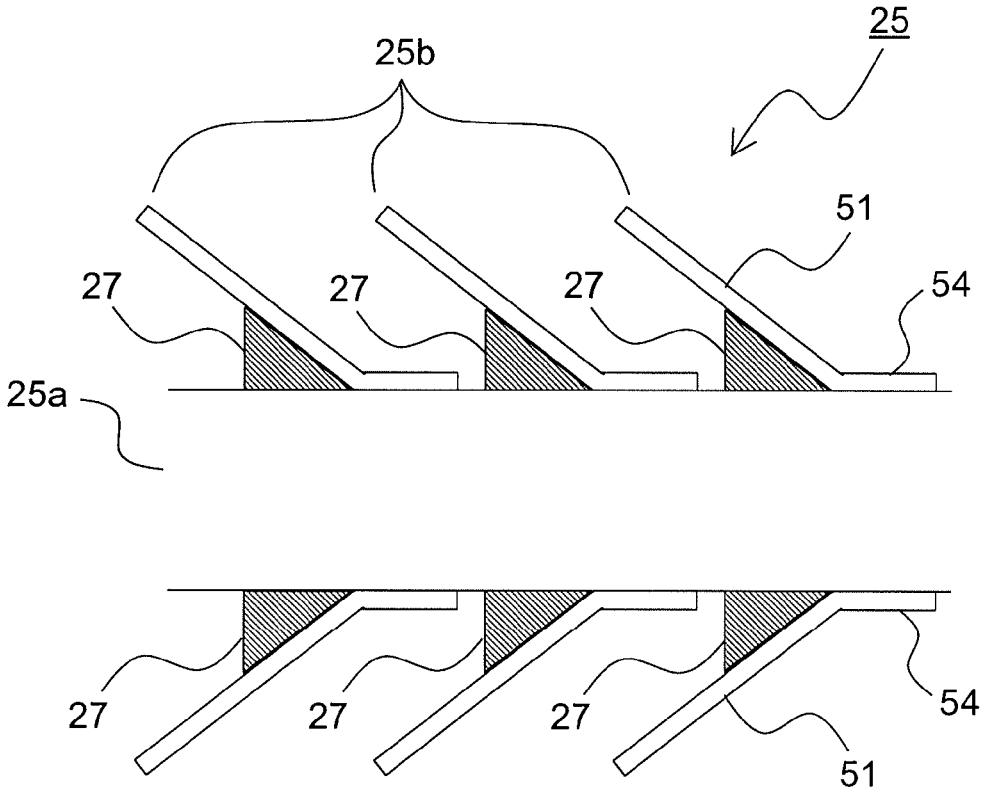
FIG. 19 is a partial sectional view of the toner dispersing member 25 using the rotary shaft 25*a* of FIG. 18.

FIG. 18 is a partial side view of the rotary shaft 25*a* to be used for the toner dispersing member 25 illustrated in FIG. 17, and FIG. 19 is a partial sectional view of the toner dispersing member 25 using the rotary shaft 25*a* of FIG. 18. To the outer peripheral surface of the rotary shaft 25*a* illustrated in FIG. 18, tapered first support members 27 made of a resin, a metal, or the like are annularly fixed at a predetermined pitch.

The fan-like first film members 51 illustrated in FIG. 9 are wrapped around the rotary shaft 25*a* to fix the fixation portion 54 thereto in a manner that an outer edge portion including the cuts 53 extends along the first support members 27. In this way, the toner dispersing member 25 having a sectional shape as illustrated in FIG. 19 is assembled.

As also for the toner dispersing member 25 illustrated in FIG. 19, the first support members 27 are arranged on the inner side of the dispersing protrusions 25*b*. Thus, the dispersing protrusions 25*b* are suppressed from falling inward even when the dispersing protrusions 25*b* are brought into contact with the inner wall surface of the housing 24 by rotation of the toner dispersing member 25. As a result, toner is effectively suppressed from being embraced among the dispersing protrusions 25*b* that have fallen inward and being lightly aggregated.

Further, each of the first support members 27 has rigidity higher compared to the structure of FIG. 17, and hence the dispersing protrusions 25*b* can be more effectively suppressed from falling inward. In addition, the first support members 27 are fixed to the rotary shaft 25*a* in advance, and hence workability in assembly of the toner dispersing member 25 is enhanced.

Figure 20:
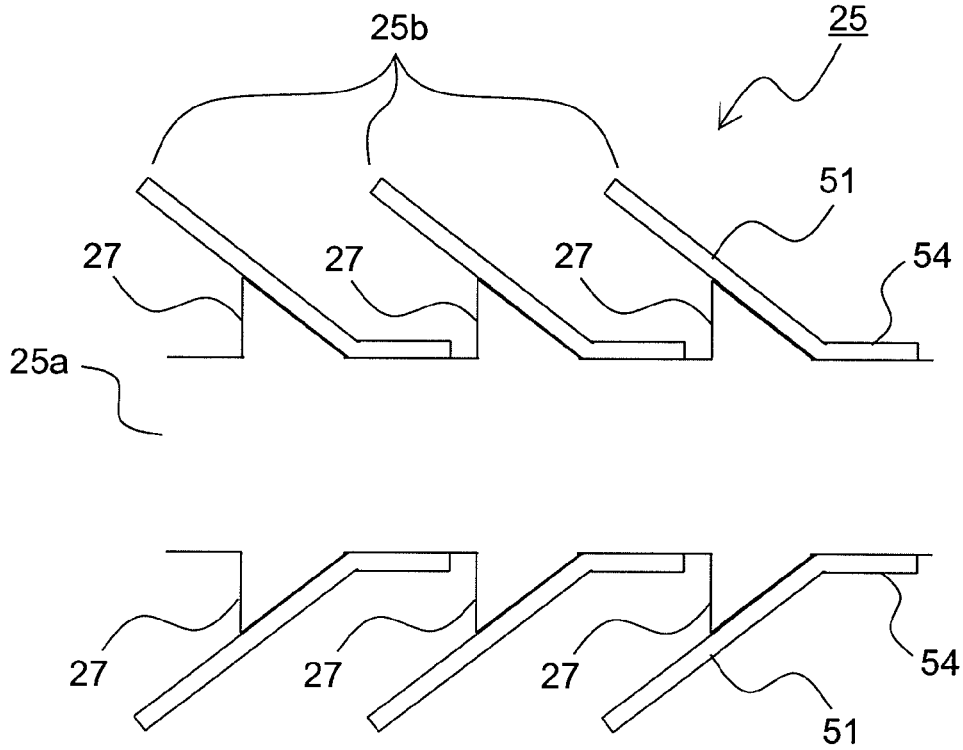
FIG. 20 is a partial sectional view of the toner dispersing member 25 formed of the plurality of first support members 27 integrated with the rotary shaft 25*a*.

With reference to FIGS. 18 and 19, description has been made of an example in which the first support members 27 and the rotary shaft 25*a* are formed of separate members. However, as illustrated in FIG. 20, the first support members 27 and the rotary shaft 25*a* may be formed integrally with each other. In this case, the workability in assembly of the toner dispersing member 25 is further enhanced. Alternatively, when the first support member 27 having a helical shape is formed integrally with the rotary shaft 25*a* in advance, the dispersing protrusions 25*b* can be formed with use of the ribbon-like first film member 51 as illustrated in FIG. 6.

Figure 21:
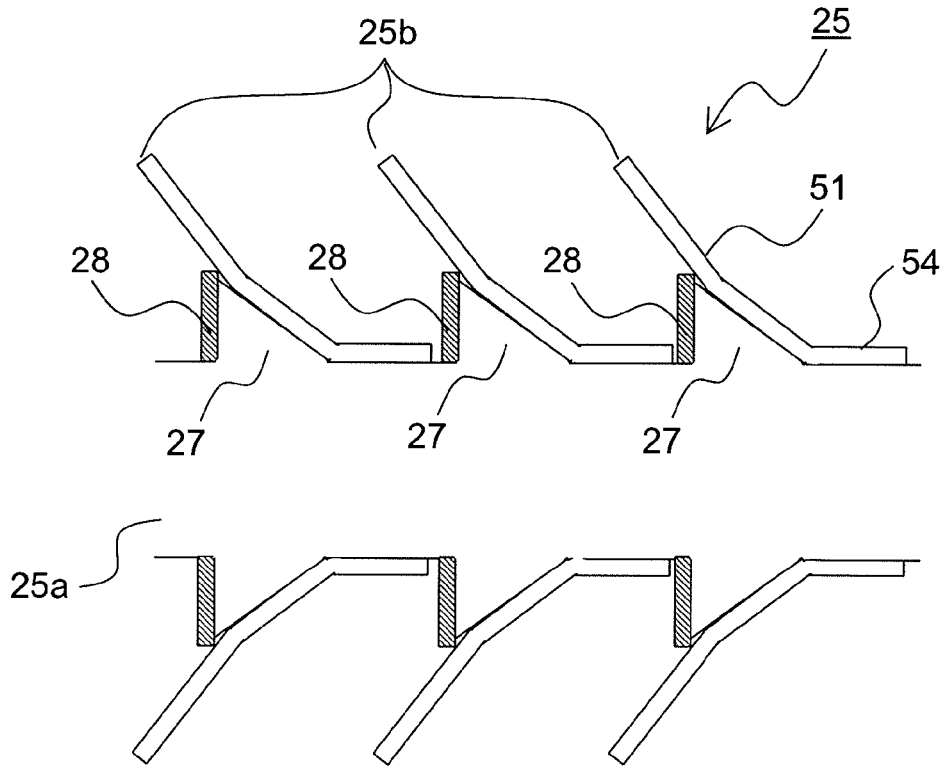
FIG. 21 is a partial sectional view of the toner dispersing member 25 having flexible second support members 28 formed on a downstream side with respect to the first support members 27 in projecting directions of the dispersing protrusions 25*b*.

FIG. 21 is a partial sectional view illustrating another modification example of the toner dispersing member 25. In this modification example, the rotary shaft 25*a* with which the first support member 27 as illustrated in FIG. 20 is integrally formed is used. On a downstream side with respect to the first support members 27 in projecting directions of the dispersing protrusions 25*b* (left direction in FIG. 21), there are provided flexible second support members 28 each having a distal end projecting radially outward with respect to a largest diameter portion of each of the first support members 27. Other structural details are similar to those of the toner dispersing member 25 illustrated in FIG. 20.

According to the structure of FIG. 21, the first support member 27 having high rigidity causes the dispersing protrusions 25*b* to reliably maintain a shape on the fixation portion side, and the flexible second support member 28 elastically supports the distal end side of the dispersing protrusion 25*b*. Thus, the distal end portion of the dispersing protrusion 25*b* more easily rocks similarly to those of the toner dispersing members 25 illustrated in FIGS. 15 to 17, and the shape on the fixation portion side of the dispersing protrusion 25*b* is reliably maintained similarly to those of the toner dispersing members 25 illustrated in FIGS. 19 and 20. As a result, the dispersing protrusions 25*b* can be more effectively suppressed from falling and toner can be more effectively suppressed from being embraced and lightly aggregated.

Figure 22:
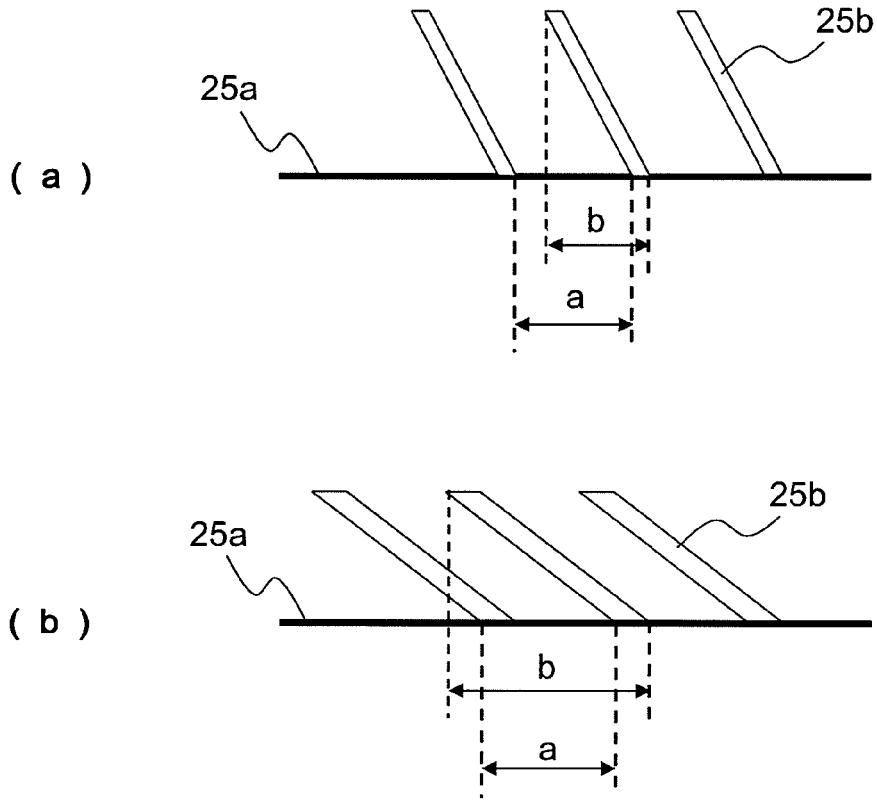
FIGS. 22A and 22B are each a partial enlarged view illustrating a relation between a pitch "a" between the dispersing protrusions 25*b* in a direction of the rotary shaft of the toner dispersing member 25 to be used in the toner dispersing mechanism 21 according to the first embodiment and a projection length "b" of one of the dispersing protrusions 25*b* with respect to the rotary shaft.

FIGS. 22A and 22B are each an enlarged sectional view of the toner dispersing member 25 to be used in the toner dispersing mechanism 21 according to the first embodiment. As illustrated in FIG. 22A, when a relation a>b is established where "a" represents an interval (pitch) of the dispersing protrusions 25*b* in a thrust direction of the rotary shaft 25*a* and "b" represents a projection length of one of the dispersing protrusions 25*b*, which is viewed from a perpendicular direction with respect to the rotary shaft 25*a*, the lump of toner injected from the toner filling port 24*a* passes through gaps among the dispersing protrusions 25*b*. As a result, there is a risk that the lump of toner is replenished from the toner discharge port 24*b* into the developing device 16 without being sufficiently dispersed.

In contrast, as illustrated in FIG. 22B, when a relation a<b is established, the lump of toner injected from the toner filling port 24*a* comes into contact with the dispersing protrusions 25*b* without fail, and is finely dispersed while being conveyed in the longitudinal direction. As a result, the lump of toner is prevented from passing through the gaps among the dispersing protrusions 25*b*, in other words, toner is prevented from insufficiently dispersed. Accordingly, it is preferred that the dispersing protrusions 25*b* be fixed to the rotary shaft 25*a* while being inclined with respect thereto by a predetermined amount so that the relation a<b is established.

Figure 23:
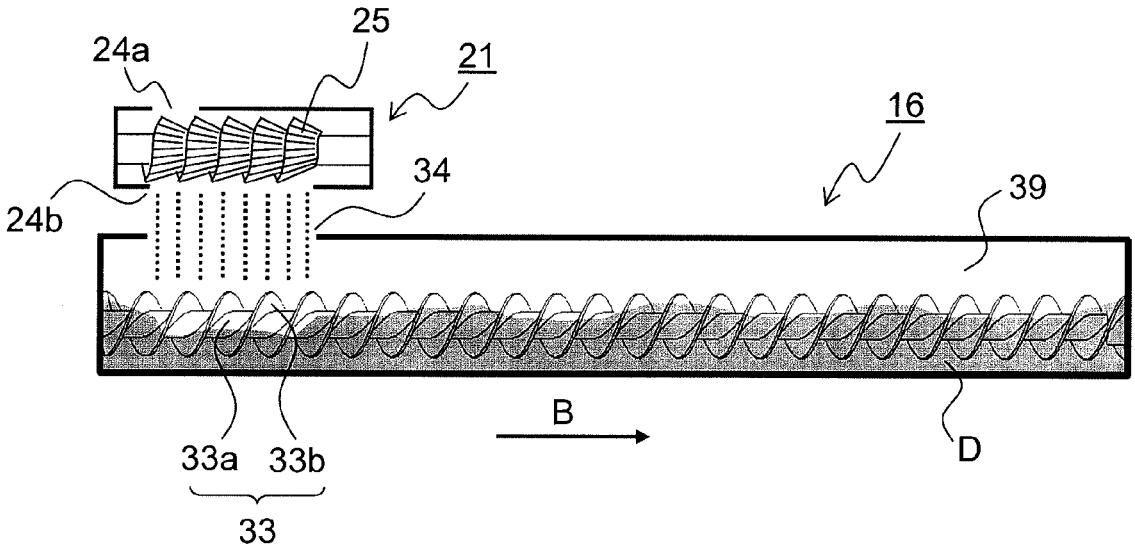
FIG. 23 is a side sectional view illustrating a positional relation between the toner dispersing mechanism 21 according to the first embodiment and the developing device 16.

FIG. 23 is a side sectional view illustrating a positional relation between the toner dispersing mechanism 21 according to the first embodiment and the developing device 16. In this embodiment, an opening width of the toner discharge port 24*b* in the longitudinal direction of the toner dispersing member 25 (lateral direction in FIG. 23) is set to be larger than an opening width of the toner filling port 24*a*. By rotation of the dispersing protrusions 25*b* which are helically arranged, the toner injected from the toner filling port 24*a* into the housing 24 is dispersed and conveyed in the longitudinal direction. As a result, the toner is supplied from substantially the entire region of the toner discharge port 24*b* into the second storage chamber 39 of the developing device 16 through the toner replenishing port 34.

With this structure, the toner is replenished over a wide range in the second storage chamber 39, and hence a toner replenishment amount per unit area with respect to the developing device 16 can be reduced. Thus, developer D existing in the second storage chamber 39 and the replenished toner can be quickly mixed with each other with the second stirring-and-conveying screw 33. The opening width of the toner discharge port 24*b* can be appropriately set in accordance with properties of toner to be used and specifications of the developing device 16 and the like.

Further, as illustrated in FIG. 23, the developer D at a position immediately below the toner discharge port 24*b* (toner dropping position) is smaller in height in comparison with heights of other parts, and hence an upper surface of the rotary shaft 33*a* of the second stirring-and-conveying screw 33 is exposed. With this, the toner discharged from the toner discharge port 24*b* is replenished to a vicinity of the rotary shaft 33*a* of the second stirring-and-conveying screw 33 through the toner replenishing port 34, and conveyed in the direction of the arrow B while being caused to alternately ascend and descend by the helical blade 33*b*. Accordingly, newly replenished toner can be efficiently stirred together with the developer D.

As a method of reducing the height of the developer D at a position immediately below the toner discharge port 24*b*, there are methods of partially changing a conveying speed of the developer in the second storage chamber 39 by changing the pitch of the helical blade 33*b* or providing ribs to the rotary shaft 33*a*.

Note that, as for the toner dispersing member 25 as illustrated in FIGS. 10 and 17, which has the dispersing protrusions 25*b* formed of the plurality of annularly-arranged first film members 51, a force for conveying toner into the longitudinal direction (direction of the rotary shaft 25*a*) of the toner dispersing member 25 is somewhat smaller than that of the toner dispersing member 25 as illustrated in FIGS. 7 and 15, which has the dispersing protrusions 25*b* formed of the single helically-arranged first film member 51. Thus, in a case where the opening width of the toner discharge port 24*b* is formed large to supply toner over a wide range from the entire region of the opening width, it is more preferred to helically arrange the dispersing protrusions 25*b* as illustrated in FIGS. 7 and 15 so that the force for conveying toner into the direction of the rotary shaft 25*a* is increased.

Figure 24:
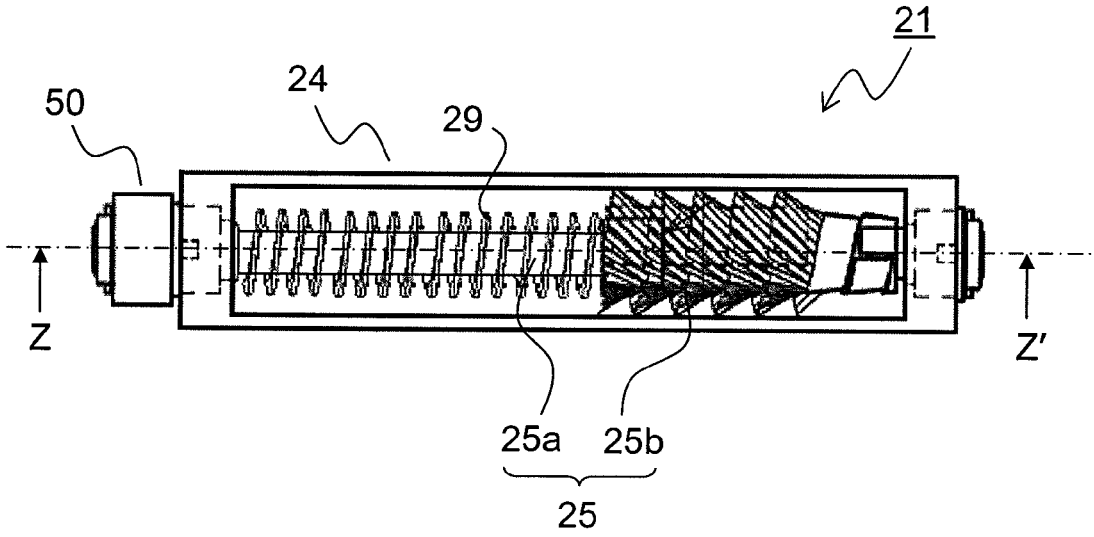
FIG. 24 is a plan view of the toner dispersing mechanism 21 according to a second embodiment of the present disclosure.
Figure 25:
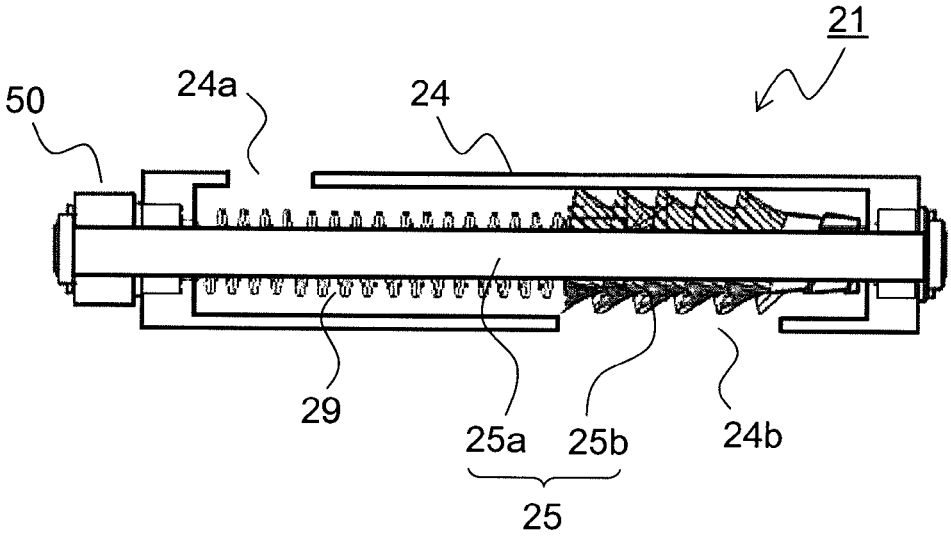
FIG. 25 is a side sectional view of the toner dispersing mechanism 21 according to the second embodiment.

FIG. 24 is a plan view of the toner dispersing mechanism 21 according to a second embodiment of the present disclosure, and FIG. 25 is a side sectional view (sectional view taken along the arrows Z-Z' in FIG. 24) of the toner dispersing mechanism 21 according to the second embodiment. In this embodiment, by provision of a helical conveying blade to a part of the outer peripheral surface of the rotary shaft 25*a* forming the toner dispersing member 25, the part being free from the dispersing protrusions 25*b*, a part of the rotary shaft 25*a* is used as a screw portion 29. Further, the toner filling port 24*a* is formed above the screw portion 29, and the toner discharge port 24*b* is formed below the dispersing protrusions 25*b*. Other structural details are the same as those in the first embodiment, and hence description thereof is omitted.

With this structure, the toner injected from the toner filling port 24*a* into the housing 24 is conveyed to the dispersing protrusions 25*b* by rotation of the screw portion 29. After a lump of toner is dispersed into particles by the dispersing protrusions 25*b*, the dispersed toner is supplied from the toner discharge port 24*b* into the toner replenishing port 34 (refer to FIG. 23). Accordingly, the lump of toner can be efficiently dispersed even when the toner discharge port 24*b* cannot be formed immediately below the toner filling port 24*a* because of the limitation on layout of the interior of the image forming apparatus 100.

By coupling the toner dispersing mechanism 21 as described above to an upper portion of the developing container 31, developer existing in the developing container 31 and toner replenished from the toner container 20 can be sufficiently mixed with each other within a short period of time. As a result, an aging time period for the developing device 16 is shortened.

Figure 26:
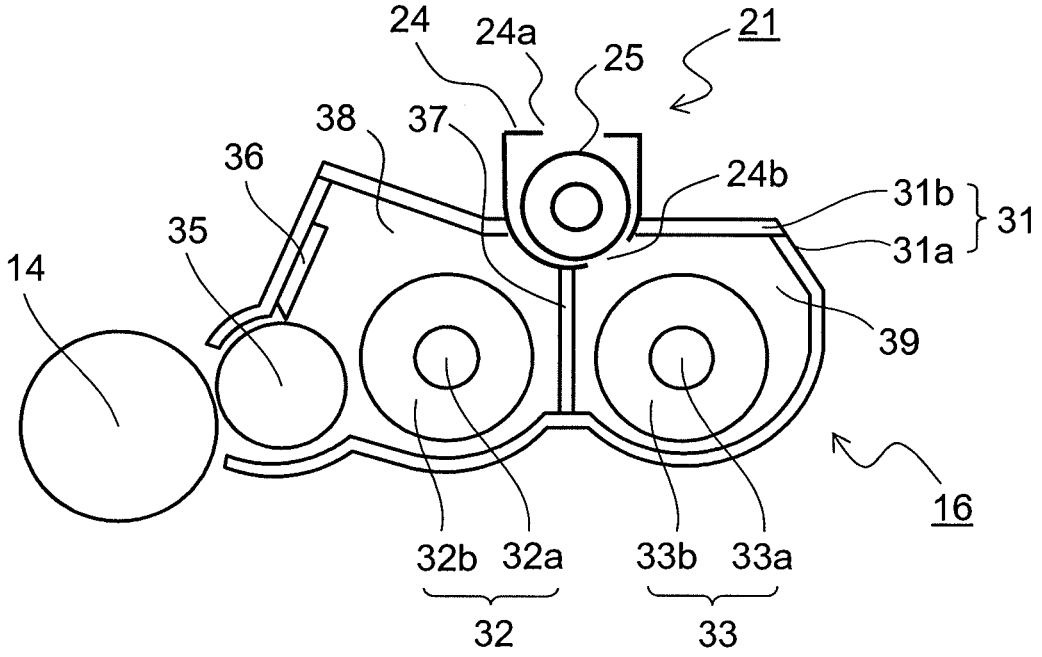
FIG. 26 is a side sectional view illustrating an example in which the toner dispersing mechanism 21 is arranged on a boundary between a first storage chamber 38 and a second storage chamber 39 of the developing device 16.

Note that, although description is made of an example in which, according to each of the above-mentioned embodiments, the toner discharge port 24*b* is provided through the lower surface of the housing 24 in the toner dispersing mechanism 21 and the toner dispersing mechanism 21 is arranged immediately above the second storage chamber 39 of the developing device 16, the present disclosure is not limited to this structure. For example, as illustrated in FIG. 26, the toner dispersing mechanism 21 may be arranged on a boundary between the first storage chamber 38 and the second storage chamber 39, and the toner discharge port 24*b* communicating to the second storage chamber 39 may be formed through a side surface of the housing 24. With this structure, an arrangement space for the toner dispersing mechanism 21 can be saved.

Figure 27:
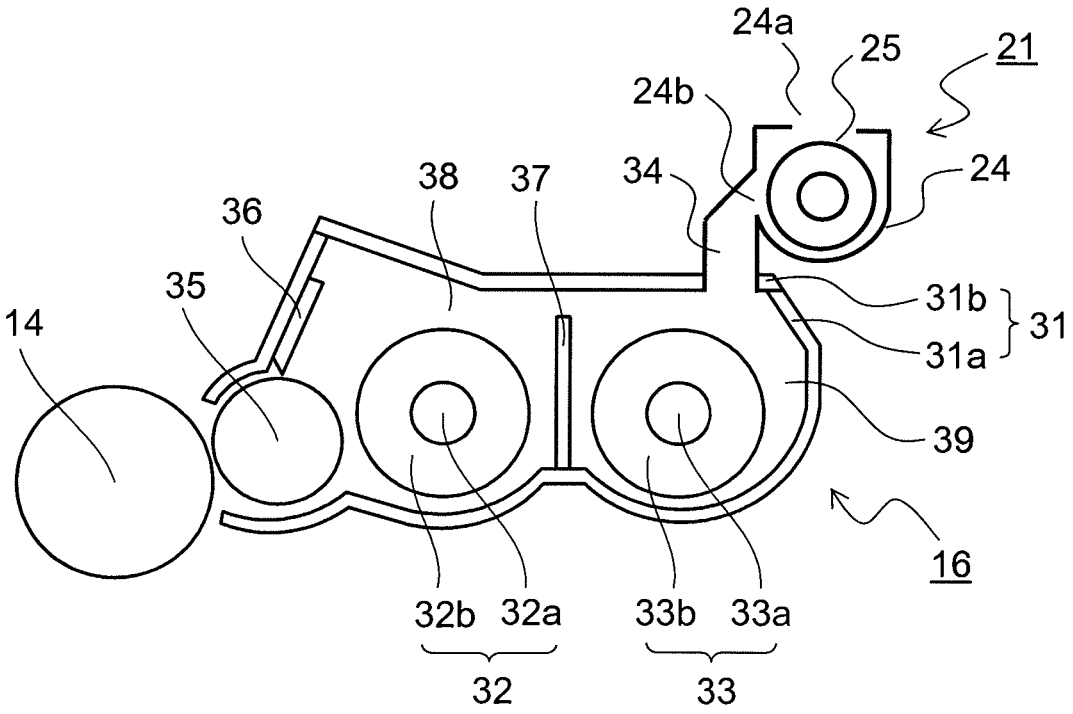
FIG. 27 is a side sectional view illustrating an example in which the toner dispersing mechanism 21 is arranged obliquely above the developing device 16.

Further, because of the limitation on layout of the image forming apparatus 100, the toner dispersing mechanism 21 may not be arranged immediately above the developing device 16 in some cases. In such cases, for example, as illustrated in FIG. 27, the toner discharge port 24*b* is formed through the side surface of the housing 24 of the toner dispersing mechanism 21, and the toner replenishing port 34 for communicating the toner discharge port 24*b* and the second storage chamber 39 to each other is formed in a bent shape. With this, toner dropping positions can be controlled.

In the toner dispersing mechanism 21 described in each of the above-mentioned embodiments, it is preferred to configure the toner dispersing member 25 to be forward-and-reverse rotatable. For example, the direction of the arrow in FIG. 11 (clockwise direction) is defined as a forward rotation, and a reverse direction (counterclockwise direction) is defined as a reverse rotation. During normal image formation, the toner dispersing member 25 performs forward rotation. At timings of turning on and restoring from a sleep (power saving) mode of the image forming apparatus 100, or a time point at which the driving time period of the toner dispersing mechanism 21 reaches a predetermined time period, the toner dispersing member 25 performs reverse rotation. With this, the dispersing protrusions 25*b*, which have fallen into the direction of the rotary shaft 25*a* by the forward rotation, can be raised again.

Further, during the reverse rotation, the dispersing protrusions 25*b* come into contact and separate from the projecting portion 26 in a direction reverse to that during the forward rotation. Thus, a rocking condition of the dispersing protrusions 25*b* is different from that during the forward rotation. With this, lightly aggregated toner among the dispersing protrusions 25*b*, which has not been completely removed during the forward rotation, can be effectively removed.

Further, by reciprocating the toner dispersing member 25 into the thrust direction (direction of the rotary shaft 25*a*) while rotating the toner dispersing member 25, the dispersing protrusions 25*b* rock not only in the rotational direction but also in the thrust direction. As a result, the dispersing protrusions 25*b* complexly rock in a twisted manner. With this, lightly aggregated toner embraced among the dispersing protrusions 25*b* can be more effectively removed.

Figure 28:
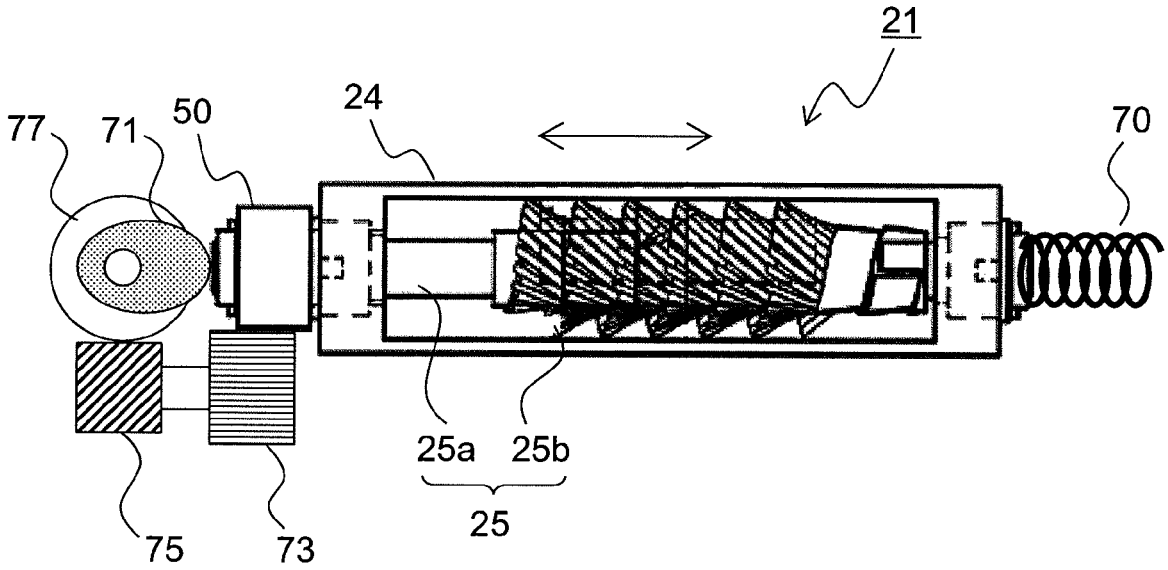
FIG. 28 is a plan view of the toner dispersing mechanism 21 having a mechanism for reciprocating the toner dispersing member 25 in a thrust direction.

As a mechanism for reciprocating the toner dispersing member 25 into the thrust direction while rotating the same, a cam mechanism as illustrated in FIG. 28 can be exemplified. In FIG. 28, one end of the rotary shaft 25*a* is supported by a coil spring 70, and another end of the rotary shaft 25*a* is held in abutment against an eccentric cam 71. A worm gear 75 which rotates integrally with a drive output gear 73 for transmitting a driving force to the drive input gear 50 is attached to a rotary shaft of the drive output gear 73, and a worm wheel 77 which rotates integrally with the eccentric cam 71 is coupled to the worm gear 75.

Further, the toner dispersing member 25 may be configured to rotate at different speeds based on an amount of toner to be replenished from the toner container 20 to the developing device 16. Specifically, the rotational speed of the toner dispersing member 25 is controlled as follows. The amount of toner to be replenished to the developing device 16 is determined based on a detection result from the toner concentration sensor 44, and hence the toner replenishing amount is calculated based on a detection signal sent from the toner concentration sensor 44 and received by the control portion 30 (refer to FIG. 1). Then, a rotational speed of a drive mechanism (not shown) coupled to the drive input gear 50 is controlled based on the toner replenishing amount thus calculated.

With this configuration, when the toner replenishing amount is large, the rotational speed of the toner dispersing member 25 can be increased to enhance a toner dispersing capability. Further, the toner dispersing member 25 may be configured to rotate at different speeds not in accordance with the toner replenishing amount but in accordance with toner fluidity. The toner fluidity varies in accordance with temperature and humidity in the image forming apparatus 100, and hence can be estimated from an output value sent from an in-apparatus temperature-and-humidity sensor (not shown) to the control portion 30.

Besides the above, the present disclosure is not limited to the above-mentioned embodiments, and various modifications may be made thereto within the spirit of the present disclosure. That is, structures and configurations obtained by arbitrarily combining the above-mentioned embodiments are encompassed by the present disclosure. For example, the toner dispersing member 25 according to the modification examples of the first embodiment may be used in the toner dispersing mechanism 21 according to the second embodiment. Further, the developing device 16 including the toner dispersing mechanism 21 according to the present disclosure is not limited to the developing device 16 as illustrated in FIGS. 2 and 3. The developing device 16 may include a developing device including a stirring paddle provided between the first stirring-and-conveying screw 32 and the developing roller 35, and a developing device including a supply roller (magnetic roller) provided between the first stirring-and-conveying screw 32 and the developing roller 35. Further, the present disclosure is not limited to a structure in which two stirring-and-conveying members 32 and 33 are provided, and is applicable, for example, to a developing device including one stirring-and-conveying member.

In the above-mentioned embodiments, the developing device is exemplified in which the two-component developer including a magnetic carrier and toner is used. However, the present disclosure is applicable also to a developing device in which a one-component developer formed only of toner is used. Further, the image forming apparatus of the present disclosure is not limited to a monochrome printer as illustrated in FIG. 1, and may include other image forming apparatuses such as a monochrome copier, a color copier, a color printer, and a facsimile. In the following examples, further description is made of advantages of the present disclosure.

EXAMPLE 1

Research was conducted on developing performance in a case of using the developing device of the present disclosure. Testing conditions were set as follows. The first film member 51 as illustrated in FIG. 6 was prepared by forming the large number of cuts 53 each having a width of 75 μm and an angle of 75° on one side of a ribbon-like film having a width of 8 mm. The first film member 51 was helically wrapped around the outer peripheral surface of the rotary shaft 25*a* with a diameter of 6 mm so as to form the dispersing protrusions 25*b*. In this way, the toner dispersing member 25 as illustrated in FIG. 7, which had a brush diameter of 14 mm, was prepared. The toner dispersing member 25 was attached to the housing 24 as illustrated in FIG. 4, which had a longitudinal dimension of 40 mm and a width dimension of 15 mm (inside dimension of 13 mm). In this way, the toner dispersing mechanism 21 according to the first embodiment, in which an intruding amount of the dispersing protrusions 25*b* with respect to the inner wall surface of the housing 24 was set to 0.5 mm, was prepared.

Then, as illustrated in FIG. 11, the projecting portion 26 was formed in the vicinity of the downstream side of the toner discharge port 24*b* of the housing 24. The toner dispersing mechanism 21 in which the intruding amount of the dispersing protrusions 25*b* with respect to the projecting portion 26 thus formed was set to 0.5 mm (total intruding amount was 1.0 mm) was defined as a present disclosure 1, and the toner dispersing mechanism 21 in which the intruding amount of the dispersing protrusions 25*b* with respect to the projecting portion 26 was set to 1.0 mm (total intruding amount was 1.5 mm) was defined as a present disclosure 2. Further, the toner dispersing mechanism 21 free from the projecting portion 26 was defined as a comparison example 1.

With use of the image forming apparatus 100 illustrated in FIG. 1, in which the toner dispersing mechanisms 21 thus prepared of the present disclosure 1, the present disclosure 2, and the comparison example 1 were attached between the developing device 16 and the toner container 20, solid images of different densities were sequentially printed. Image densities (ID) after printing of 100 k sheets (100,000 sheets) were measured with a reflection densitometer (Macbeth RD912). Further, as a result of visual observation of fogging, a case where occurrence of fogging was not confirmed was indicated by o, and a case where occurrence of fogging was confirmed was indicated by x. Note that, as driving conditions of the image forming apparatus 100, a drum linear velocity (processing speed) was set to 260 mm/sec, and a rotational speed of the toner dispersing member 25 was set to 126 mm/sec. Table 1 shows the results of Example 1.

TABLE 1

| | Present Disclosure 1 | | Present Disclosure 2 | | Comparison Example 1 | |
|---|---|---|---|---|---|---|
| | Solid Density | Fogging | Solid Density | Fogging | Solid Density | Fogging |
| Original Document Having Coverage Rate of 5% | 1.44 | o | 1.41 | o | 1.45 | o |
| Original Document Having Coverage Rate of 10% | 1.42 | o | 1.46 | o | 1.42 | o |
| Original Document Having Coverage Rate of 20% | 1.48 | o | 1.43 | o | 1.46 | o |
| Original Document Having Coverage Rate of 30% | 1.44 | o | 1.45 | o | 1.44 | x |
| Original Document Having Coverage Rate of 50% | 1.43 | x | 1.47 | o | 1.41 | x |

Table 1 clearly shows that, after printing the images having the coverage rates of from 5% to 20%, no problems of image density and fogging were found in any of the present disclosures 1 and 2, and the comparison example 1. Meanwhile, in the case of printing the images having the coverage rate of 30%, occurrence of fogging was confirmed in the comparison example 1. The reason for the occurrence of fogging may be considered as follows. In the comparison example 1 in which the housing is free from the projecting portion 26, the toner replenishing amount does not decrease, and hence the image density does not decrease even after the images having a high coverage rate have been output. However, the intruding amount of the dispersing protrusions 25*b* is small, specifically, 0.5 mm, and hence toner clogs the gaps among the dispersing protrusions 25*b*. As a result, an effect of breaking a lump of toner into particles decreases. Thus, the developer in the developing device 16 and the replenished toner cannot be sufficiently mixed with each other, with the result that toner is not stably charged.

Further, in the present disclosure 1 in which the total intruding amount of the dispersing protrusions 25*b* was set to 1.0 mm, occurrence of fogging was confirmed after printing images having the coverage rate of 50%. Meanwhile, in the present disclosure 2 in which the total intruding amount of the dispersing protrusions 25*b* was set to 1.5 mm, occurrence of fogging was not confirmed. This may be because the dispersing protrusions 25*b* can be sufficiently curved from the root parts thereof as the intruding amount of the dispersing protrusions 25*b* increases, with the result that toner can be effectively suppressed from clogging the gaps among the dispersing protrusions 25*b*.

From the above-mentioned results, the following was confirmed: with use of the toner dispersing mechanism 21 according to the present disclosure, in which the projecting portion 26 with which the dispersing protrusions 25*b* came into contact was formed on the inner wall surface of the housing 24, the developer in the developing device 16 and the replenished toner was able to be sufficiently mixed with each other, which was advantageous in stably charging toner.

EXAMPLE 2

The first film member 51 as illustrated in FIG. 6 was prepared by forming the large number of cuts 53 each having a width of 75 μm and an angle of 75° on one side of a ribbon-like film having a width of 8 mm. The first film member 51 and the ribbon-like second film member 60 as illustrated in FIG. 14 were helically wrapped around the outer peripheral surface of the rotary shaft 25*a* with a diameter of 6 mm so as to form the dispersing protrusions 25*b* and the first support member 27. In this way, the toner dispersing member 25 as illustrated in FIG. 15, which had a brush diameter of 14 mm, was prepared.

The toner dispersing mechanism 21 in which angles of each of the dispersing protrusions 25*b* held by the first support member 27 was set to 10° was defined as a present disclosure 3, the toner dispersing mechanism 21 in which angles thereof was set to 20° was defined as a present disclosure 4, and the toner dispersing mechanism 21 in which angles thereof was set to 30° was defined as a present disclosure 5. Further, the toner dispersing mechanism 21 free from the first support member 27 was defined as a comparison example 2.

Further, the first film member 51 as illustrated in FIG. 6 was prepared by forming the large number of cuts 53 each having a width of 75 μm and an angle of 75° on one side of a ribbon-like film having a width of 11 mm. The first film member 51 and the ribbon-like second film member 60 as illustrated in FIG. 14 were helically wrapped around the outer peripheral surface of the rotary shaft 25*a* with a diameter of 6 mm so as to form the dispersing protrusions 25*b* and the first support member 27. In this way, the toner dispersing member 25 as illustrated in FIG. 15, which had a brush diameter of 14 mm, was prepared. The toner dispersing mechanism 21 in which angles of each of the dispersing protrusions 25*b* held by the first support member 27 was set to 20° was defined as a present disclosure 6. Further, the toner dispersing mechanism 21 free from the first support member 27 was defined as a comparison example 3.

The toner dispersing members of the present disclosures 3 to 6 and the comparison examples 2 and 3 were each attached to the housing 24 as illustrated in FIG. 4, which had a longitudinal dimension of 40 mm and a width dimension of 15 mm (inside dimension of 13 mm). In this way, the toner dispersing mechanism 21 according to the first embodiment, in which an intruding amount of the dispersing protrusions 25*b* with respect to the inner wall surface of the housing 24 was set to 0.5 mm, was prepared.

With use of the image forming apparatus 100 illustrated in FIG. 1, in which the toner dispersing mechanisms 21 thus prepared were attached between the developing device 16 and the toner container 20, solid images of different densities were sequentially printed. Image densities (ID) after printing of 100 k sheets (100,000 sheets) were measured with a reflection densitometer (Macbeth RD912). Further, as a result of visual observation of fogging, a case where occurrence of fogging was not confirmed was indicated by o, and a case where occurrence of fogging was confirmed was indicated by x. Note that, as driving conditions of the image forming apparatus 100, a drum linear velocity (processing speed) was set to 260 mm/sec, and a rotational speed of the toner dispersing member 25 was set to 126 mm/sec. Table 2 shows the results of Example 2.

TABLE 2

| Coverage Rate of Original | Present Disclosure 3 | | Present Disclosure 4 | | Present Disclosure 5 | | Present Disclosure 6 | | Comparison Example 2 | | Comparison Example 3 | |
|---|---|---|---|---|---|---|---|---|---|---|---|---|
| Document | Density | Fogging | Density | Fogging | Density | Fogging | Density | Fogging | Density | Fogging | Density | Fogging |
| 5% | 1.44 | o | 1.42 | o | 1.44 | o | 1.42 | o | 1.45 | o | 1.42 | o |
| 10% | 1.48 | o | 1.46 | o | 1.47 | o | 1.44 | o | 1.45 | o | 1.47 | o |
| 20% | 1.46 | o | 1.43 | o | 1.43 | o | 1.41 | o | 1.46 | x | 1.43 | o |
| 30% | 1.44 | o | 1.46 | o | 1.44 | o | 1.44 | o | 1.42 | x | 1.44 | x |
| 50% | 1.43 | x | 1.47 | x | 1.43 | o | 1.49 | o | 1.41 | x | 1.47 | x |

From the above-mentioned results of the test, the following was confirmed: until printing 70 k sheets (70,000 sheets) of images having the coverage rate of from 5% to 50%, no problems of image density and fogging were found in any of the present disclosures 3 to 6, and the comparison examples 2 and 3. Further, Table 2 clearly shows that, even after printing 100 k sheets of the images having the coverage rates of from 5% to 10%, no problems of image density and fogging were found in any of the present disclosures 3 to 6, and the comparison examples 2 and 3.

Meanwhile, occurrence of fogging was confirmed after printing 100 k sheets of the images having the coverage rate of 20% in the comparison example 2, and occurrence of fogging was confirmed after printing 100 k sheets of the images having the coverage rate of 30% in the comparison example 3. The reason for the occurrence of fogging may be considered as follows. In the comparison examples 2 and 3 in which the housing 24 is free from the first support member 27, the toner replenishing amount does not decrease, and hence the image density does not decrease even after the images having a high coverage rate have been output. However, the dispersing protrusions 25*b* are liable to fall into the direction of the rotary shaft 25*a*, and hence toner clogs the gaps among the dispersing protrusions 25*b*. As a result, an effect of breaking a lump of toner into particles decreases. Thus, the developer in the developing device and the replenished toner cannot be sufficiently mixed with each other, with the result that toner is not stably charged.

Further, in the present disclosure 3 in which the width of the first film member 51 (brush length) was set to 8 mm and the angle of each of the dispersing protrusions 25*b* was set to 10°, and in the present disclosure 4 in which the width of the first film member 51 was set to 8 mm and the angle of each of the dispersing protrusions 25*b* was set to 20°, occurrence of fogging was confirmed after printing 100 k sheets of the images having the coverage rate of 50%. However, in the present disclosure 5 in which the width of the first film member 51 was set to 8 mm and the angle of each of the dispersing protrusions 25*b* was set to 30°, and the present disclosure 6 in which the width of the first film member 51 was set to 11 mm and the angle of each of the dispersing protrusions 25*b* was set to 20°, occurrence of fogging was not confirmed even after printing 100 k sheets. This may be because, as the angle of each of the dispersing protrusions 25*b* increases, and as the brush length increases, toner can be effectively suppressed from clogging the gaps among the dispersing protrusions 25*b*.

From the above-mentioned results, the following was confirmed: with use of the toner dispersing member 25 according to the present disclosure, which includes the first support member 27 for supporting the dispersing protrusions 25*b* at a predetermined angle with respect to the outer peripheral surface of the rotary shaft 25*a*, the developer in the developing device 16 and the replenished toner was able to be sufficiently mixed with each other, which was advantageous in stably charging toner. Note that, although not disclosed herein, the similar advantage has been confirmed also in a case of using the toner dispersing member 25 illustrated in FIG. 21, which has the dispersing protrusions 25*b* supported by the tapered first support members 27 and the flexible second support members 28 at a predetermined angle.

The present disclosure is applicable to an image forming apparatus in which toner is replenished from a toner storage container such as a hopper and a container into a developing device. The toner dispersing mechanism according to the present disclosure includes: a housing including a toner filling port communicating to the toner storage container and a toner discharge port communicating to the developing device; a dispersing member including a rotary shaft rotatably supported in the housing, and a large number of dispersing protrusions made of an elastic material and formed on an outer peripheral surface of the rotary shaft; and a projecting portion formed continuously at least at a part of an inner wall surface in a longitudinal direction of the housing, the large number of dispersing protrusions facing the part and coming into contact with the projecting portion.

By arranging the toner dispersing mechanism according to the present disclosure between the toner storage container and the developing device, toner to be supplied from the toner storage container can be sufficiently dispersed before being replenished into the developing device. In addition, developer existing in the developing device and the toner replenished from the toner storage container are sufficiently mixed with each other within a short period of time. Thus, it is possible to provide an image forming apparatus capable of effectively suppressing image failures such as density unevenness and fogging.

What is claimed is:

1. A toner dispersing mechanism, comprising;

a housing arranged between a toner storage container and a developing device, the housing having a toner filling port communicating with toner storage container, and a toner discharge port communicating with the developing device;

a toner dispersing member including a rotary shaft rotatably supported in the housing, and a large number of dispersing protrusions, made of an elastic material and formed on an outer peripheral surface of the rotary shaft, for dispersing a lump of toner to come into contact with the large number of dispersing protrusions by rotating the toner dispersing member about the rotary shaft; and a projecting portion formed continuously at least at a part of an inner wall surface in a longitudinal direction of the housing, the large number of dispersing protrusions facing the inner wall surface part and coming into contact with the projecting portion, wherein toner replenished from the toner storage container is dispersed and discharged into the developing device, wherein the large number of dispersing protrusions are formed by wrapping a flexible film member around the outer peripheral surface of the rotary shaft, wherein the flexible film member includes a large number of cuts formed on one side thereof, and wherein the cuts are directed outward.

2. A toner dispersing mechanism according to claim 1, wherein the projecting portion is formed in a vicinity of a downstream side with respect to an opening edge of the toner discharge port in a rotational direction of the toner dispersing member.

3. A toner dispersing mechanism according to claim 1, further comprising a protrusion projecting to an upstream side in a rotational direction of the toner dispersing member, the protrusion being formed at an end portion of the projecting portion on the upstream side in the rotational direction of the toner dispersing member.

4. A toner dispersing mechanism according to claim 3, wherein a distance from the inner wall surface of the housing and the protrusion is 50% or more of a distance from the inner wall surface of the housing to the outer peripheral surface of the rotary shaft.

5. A toner dispersing mechanism according to claim 1, wherein an opening width of the toner discharge port in a longitudinal direction of the toner dispersing member is set to be larger than an opening width of the toner filling port, and wherein the toner dispersing member disperses toner injected from the toner filling port into the housing and discharges the toner from substantially an entire region of the toner discharge port.

6. A toner dispersing mechanism according to claim 1, wherein the dispersing protrusions are fixed while being inclined with respect to an axial direction of the rotary shaft, and wherein a projection length of each of the dispersing protrusions with respect to the rotary shaft is larger than a pitch between the dispersing protrusions in a direction of the rotary shaft.

7. A toner dispersing mechanism according to claim 6, wherein the dispersing protrusions are helically arranged with respect to the rotary shaft.

8. A toner dispersing mechanism according to claim 1, wherein the toner dispersing member further comprises a first support member for supporting the large number of dispersing protrusions at a predetermined angle with respect to the outer peripheral surface of the rotary shaft.

9. A toner dispersing mechanism according to claim 8, wherein the first support member comprises a plurality of first support members annularly provided at a predetermined pitch around the outer peripheral surface of the rotary shaft, and wherein the dispersing protrusions are formed of a plurality of fan-like film members each including a large number of cuts from an outer edge to an inner edge and wrapped around the outer peripheral surface of the rotary shaft respectively along the plurality of first support members, the fan-like film members each having an inner peripheral side free from the cuts and serving as a fixation portion.

10. A toner dispersing mechanism according to claim 8, wherein the first support member is helically provided at a predetermined pitch around the outer peripheral surface of the rotary shaft, and wherein the dispersing protrusions are formed of a ribbon-like film member including a large number of cuts longitudinally along one side and helically wrapped around the outer peripheral surface of the rotary shaft along the first support member, the ribbon-like film member having a side free from the cuts and serving as a fixation portion.

11. A toner dispersing mechanism according to claim 8, wherein the first support member is formed integrally with the rotary shaft.

12. A toner dispersing mechanism according to claim 8, wherein the toner dispersing member further comprises a flexible second support member which is formed on a downstream side with respect to the first support member in a projecting direction of each of the large number of dispersing protrusions, and which has a distal end projecting radially outward with respect to a largest diameter portion of the first support member.

13. A toner dispersing mechanism according to claim 8, wherein the first support member is formed of a film member having an L-shape in cross section, which comprises:

a fixation portion to be fixed to the rotary shaft; and a support portion provided substantially perpendicularly upright on one side in a longitudinal direction of the fixation portion and including cuts orthogonal to the longitudinal direction, the film member being wrapped around the outer peripheral surface of the rotary shaft.

14. A toner dispersing mechanism according to claim 1, wherein the rotary shaft includes a screw portion which exerts a conveying force directed from the toner filling port to the toner discharge port and which is formed adjacently to the large number of dispersing protrusions, and wherein the toner filling port is formed immediately above the screw portion.

15. A toner dispersing mechanism according to claim 1, wherein the toner dispersing member is capable of reciprocating in a thrust direction.

16. A developing device, comprising:

the toner dispersing mechanism according to claim 1; and a developing container having an upper portion to which the toner dispersing mechanism is coupled.

17. An image forming apparatus, comprising:

the developing device, according to claim 16; and the toner storage container, the toner storage container being detachably arranged above the toner dispersing mechanism, for storing toner to he replenished into the developing device through intermediation of the toner dispersing mechanism.

18. An image forming apparatus according to claim 17, further comprising control means for changing a rotational speed of the toner dispersing member based on at least one of an amount of toner to be replenished from the toner storage container and toner fluidity.

19. A toner dispersing mechanism, comprising;

a housing arranged between a toner storage container and a developing device, the housing having a toner filling port communicating to with the toner storage container, and a toner discharge port communicating with the developing device;

a toner dispersing member including a rotary shaft rotatably supported in the housing, and a large number of dispersing protrusions, made of an elastic material and formed on an outer peripheral surface of the rotary shaft, for dispersing a lump of toner to come into contact with the large number of dispersing protrusions by rotating the toner dispersing member about the rotary shaft; and a projecting portion formed continuously at least at a part of an inner wall surface in a longitudinal direction of the housing, the large number of dispersing protrusions facing the inner wall surface part and coming into contact with the projecting portion, wherein toner replenished from the toner storage container is dispersed and discharged into the developing device, and wherein the toner dispersing member is forward-and-reverse rotatable.

20. A developing device for use in an image forming apparatus having toner storage container, the developing device comprising:

a toner dispersing mechanism;

a developing container having an upper portion to which toner dispersing mechanism is coupled; and a stirring-and-conveying member located in the developing container, the toner dispersing mechanism including a housing arranged between the toner storage container and the developing container, the housing having a toner filling port communicating with the toner storage container, and a toner discharge port communicating with the developing container, and a toner dispersing member including a rotary shaft rotatbly supported in the housing, a large number of dispersing protrusions, made of an elastic material and formed on an outer peripheral surface of the rotary shaft, for dispersing a lump of toner to come into contact with the large number of dispersing protrusions by rotating the toner dispersing member about the rotary shaft, and a projecting portion formed continuously at least at a part of an inner wall surface in a longitudinal direction of the housing, the large number of dispersing protrusions facing the inner wall surface part and coming into contact with the projecting portion, wherein toner replenished from the toner storage container is dispersed and discharged into the developing container, and the stirring-and-conveying member comprising a stirring-and-conveying blade formed on an outer peripheral surface of a stirring-and-conveying rotary shaft, which is provided at a toner dropping position to which toner discharged from the toner discharge port drops, for circulatorily conveying developer in the developing container, the developer existing also at the toner dropping position.

21. A developing device according to claim 20, wherein the developer existing at the toner dropping position is smaller in height in comparison with an upper surface of the stirring-and-conveying rotary shaft.

* * * * *